US010947815B2

(12) United States Patent
Wang et al.

(10) Patent No.: US 10,947,815 B2
(45) Date of Patent: Mar. 16, 2021

(54) TOOL ASSEMBLY WITH COLLET AND SHIFTABLE VALVE AND PROCESS FOR DIRECTING FLUID FLOW IN A WELLBORE

(71) Applicant: Advanced Completions Asset Corporation, Calgary (CA)

(72) Inventors: Jianjun Wang, Calgary (CA); John Sobolewski, Okotoks (CA)

(73) Assignee: Advanced Completions Asset Corporation, Calgary (CA)

( * ) Notice: Subject to any disclaimer, the term of this patent is extended or adjusted under 35 U.S.C. 154(b) by 337 days.

(21) Appl. No.: 15/964,185

(22) Filed: Apr. 27, 2018

(65) Prior Publication Data

US 2018/0320479 A1 Nov. 8, 2018

Related U.S. Application Data

(60) Provisional application No. 62/500,240, filed on May 2, 2017.

(51) Int. Cl.

| | |
|---|---|
| ***E21B 34/14*** | (2006.01) |
| ***E21B 43/14*** | (2006.01) |
| ***E21B 43/26*** | (2006.01) |
| ***E21B 33/12*** | (2006.01) |

(52) U.S. Cl.

CPC ..... *E21B 34/14* (2013.01); *E21B 33/12* (2013.01); *E21B 43/14* (2013.01); *E21B 43/26* (2013.01); *E21B 2200/06* (2020.05)

(58) Field of Classification Search

CPC ..... E21B 34/14; E21B 34/142; E21B 23/04

See application file for complete search history.

(56) References Cited

U.S. PATENT DOCUMENTS

| | | | | |
|---|---|---|---|---|
| 7,552,779 | B2 | 6/2009 | Murray | |
| 8,469,087 | B2 | 6/2013 | Gray | |
| 9,410,412 | B2 | 8/2016 | Stout | |
| 9,534,471 | B2 | 1/2017 | Etzel | |
| 2015/0226035 | A1 | 8/2015 | Jani | |
| 2016/0258260 | A1 | 9/2016 | Walton et al. | |
| 2016/0312581 | A1 | 10/2016 | Nordheimer | |
| 2018/0230774 | A1* | 8/2018 | Wood | E21B 34/14 |

FOREIGN PATENT DOCUMENTS

| | | | |
|---|---|---|---|
| WO | 2015/149169 | A1 | 10/2015 |
| WO | 2016/044409 | A1 | 3/2016 |

* cited by examiner

*Primary Examiner* — Kristyn A Hall

(74) *Attorney, Agent, or Firm* — Bereskin & Parr LLP/S.E.N.C.R.L., s.r.l.; Tony Orsi

(57) ABSTRACT

Various embodiments of a tool assembly for completion of wellbores and processes of using the tool assemblies are provided. In various example embodiments a tethered receptacle in receipt of a plug member is releasably coupled to a collet. The tool assembly comprises one or more shiftable valves. In a process for controlling fluid flow in a wellbore string, the collet is released from the receptacle. Engagement of the collet with a shiftable valve causes the valve to shift from a port closed to a port open position, and to plug the central bore of a wellbore string with the plug member.

20 Claims, 19 Drawing Sheets

TOOL ASSEMBLY WITH COLLET AND SHIFTABLE VALVE AND PROCESS FOR DIRECTING FLUID FLOW IN A WELLBORE

CROSS-REFERENCE

This application claims the benefit of U.S. Provisional Patent Application No. 62/500,240 filed May 2, 2017; the entire contents of U.S. Provisional Patent Application No. 62/500,240 are hereby incorporated by reference.

FIELD OF THE DISCLOSURE

The present disclosure relates to well completions and in particular valve assemblies for hydraulic fracturing.

BACKGROUND OF THE DISCLOSURE

The following paragraphs are provided by way of background to the present disclosure. They are not, however, an admission that anything discussed therein is prior art or part of the knowledge of persons skilled in the art.

Subterranean oil and gas wells require the inflow of hydrocarbon products from reservoir rock formations into the well. Various techniques, commonly known as completions, have evolved to condition a well in order to enable transport of hydrocarbon products from the surrounding rock formation to the wellbore. This includes a technique, known as multistage completion, involving the isolation of multiple zones of a reservoir formation along a wellbore and sequential staged treatment of each zone with stimulation fluids to promote fracturing of the rock formation. In order to accomplish this, operators typically install a tubular wellbore string, also known as completion string or liner.

For example, in multistage completions known as open hole completions, the completion string commonly contains multiple shiftable sleeve valves flanked by packers, as well as a wellbore isolation valve at the distal end of the string. Shifting of a sleeve valve results in the opening of a side port in the sleeve housing, allowing fluid communication between the central string bore and the wellbore and rock formation. One well known technique to achieve this involves the deploying of a ball into the completion string through which it travels until it makes contact with a matching ball seat within the sleeve valve. The sleeve valve is designed so that upon the ball making contact with the ball seat, it actuates shifting of the sleeve via hydraulic pressure provided from the surface to thereby open the side port. At the same time, when the ball makes contact with the ball seat, the ball can seal off the central string bore. Thus, fluid flow through the string is directed through the side ports.

Typically, in an open hole completion, at the outset of a fluid treatment operation, also known as a hydraulic fracturing operation, operators run the completion string with all of the sleeve valves closed and the wellbore isolation valve open. The wellbore isolation valve is then closed to seal the completion string, so that the packers can be hydraulically set. At this point, fracturing surface equipment is set up and stimulation fluids can be pumped down the wellbore so that a first zone of the formation can be treated. As the operation proceeds, separation of stimulation treatments is achieved by sequential sealing of the central tubular string passage by the ball on seat, while at the same time opening side ports in the sleeve valves. By deploying successively larger balls to actuate matching sleeves, it is possible to treat successive zones from the distal to proximal end of the wellbore.

In another example, known as cemented completions, the completion string is cemented in the wellbore and sequential stimulation treatments can be achieved by incorporating multiple sleeve valves in the completion string prior to installation, or perforating the casing after installation.

It is noted that in some operations, known as single entry operations, an isolated zone contains a single shiftable valve, while in other operations, known as limited entry operations, an isolated zone contains a cluster comprising multiple shiftable valves through which the stimulation fluid can communicate with the formation.

Once all isolated zones have been treated, it is desirable to establish an unobstructed string bore in order to maximize flow of hydrocarbon product through the completion string up the wellbore to the surface and to enable future work over operations. However, such unobstructed flow in practice can be difficult to achieve.

For example, known completion systems commonly include a shiftable sleeve comprising a ball seat that is integrally mounted within the shifting sleeve, and a matching ball with each ball seat. However, the presence of a ball seat within each shiftable sleeve substantially reduces the inside diameter within the string. This limits the achievable fluid pumping rate, and can create a significant fluid pressure drop resulting in an impediment to fluid flow. In particular, in operations involving a large number of stages, and a corresponding large number of tubular sleeves, the ball seats can substantially restrict fluid flow through the completion string and thereby negatively impact the efficiency of a hydrocarbon recovery operation. In order to limit the impact that ball seats have on fluid flow in the completion string, following wellbore treatment, ball seats can be drilled out; however, drilling operations are time consuming and expensive to perform.

Furthermore, when a multistage completion string comprising a large number of shiftable sleeves is installed, it can become operationally challenging to ensure that each ball connects with and shifts its matching sleeve. The diameter differences between the successively larger balls are necessarily relatively small and one or more balls can inadvertently open sleeves other than the matching sleeve and thus interfere with the sequential stimulation of zones.

In another completion system known in the art, a collet and a matching ball can be deployed from the surface. The ball is generally engaged with the collet via a ball seat included within the collet and the ball and collet are jointly deployed from the surface. The collet is designed to be able to engage with a shiftable valve and in certain designs can engage with multiple shiftable valves, thus overcoming some of the problems associated with the narrowing of the completion string when a ball drop system is used.

However, it can be operationally challenging to ensure that each collet connects with and shifts its matching sleeve. Fluid flow applied from the surface can be difficult to control locally within the string. In particular, when fluid flow rates are too high collets can pass through a matching sleeve without appropriately connecting and opening the sleeve. Furthermore, the presence of a residual cement sheath located in and around component geometries can cause a collet to not connect with its matching sleeve, in particular if the sleeve is not prepared properly with a lubricant to prevent cement sticking and/or hardening.

SUMMARY OF THE DISCLOSURE

The following paragraphs are intended to introduce the reader to the more detailed description that follows and not to define or limit the claimed subject matter of the present disclosure.

In one aspect, the present disclosure relates to well completions.

In another aspect, the present disclosure relates to tool assemblies for directing fluid flow for use in well completions.

Accordingly, the present disclosure provides, in one broad aspect, in accordance with the teachings herein, in at least one embodiment, a downhole assembly for directing and controlling fluid flow in a wellbore string and a reservoir formation surrounding the wellbore string, the assembly comprising:

a tubular wellbore string having a central bore therethrough;

a shiftable side-ported tubular valve interconnecting first and second portions of the wellbore string, comprising at least one side port and being shiftable from a port closed position where fluid flow through the at least one side port is blocked to a port open position where fluid flow through the at least one side port is allowed, the side-ported tubular valve having at least one inwardly biased protuberance; and an actuation member disposed within the central bore, the actuation member comprising:

a receptacle tethered to a line deployment device;

a plug member disposed within the receptacle; and a collet releasably coupled to the receptacle by a releasable coupling, the collet having at least one outwardly biased protuberance for correspondingly engaging with the at least one inwardly biased protuberance of the tubular valve, the plug member being engageable with the collet, wherein, upon release of the collet from the receptacle, the collet and the plug member while engaging one another are moveable downhole by the application of downhole directed fluid flow in the central bore, the collet being moved downhole to engage with the tubular valve through the corresponding protuberances and to cause the tubular valve to shift from a port closed position to a port open position, and the plug member being moved downhole to plug the central bore downstream of the at least one side port, and to thereby direct fluid flow through the at least one side port to a portion of the reservoir formation surrounding the wellbore string.

In at least one embodiment, the wellbore string can comprise a plurality of spaced apart side-ported tubular valves each interconnecting successive portions of the wellbore string.

In at least one embodiment, the wellbore string can comprise a plurality of spaced apart side-ported tubular valves each interconnecting successive portions of the wellbore string wherein each of the tubular valves comprises an inwardly biased protuberance for preventing further downhole movement of the collet upon the application of fluid flow to the collet and plug member while being engaged with each other.

In at least one embodiment, the wellbore string can comprise a plurality of spaced apart side-ported tubular valves each interconnecting successive portions of the wellbore string wherein the tubular valve situated furthest downhole has an inwardly biased protuberance preventing further downhole movement of the collet upon the application of fluid flow to the collet, and all other tubular valves have an inwardly biased protuberance that is structured to permit further downhole movement of the collet upon the application of sufficient fluid flow to the collet and plug member while being engaged with each other.

In at least one embodiment, the receptacle can be tethered to a wireline or coiled tubing.

In at least one embodiment, the releasable coupling can comprise a shearable member.

In at least one embodiment, the releasable coupling can comprise two or more shearable members, each shearable member being shearable at a different shear force.

In at least one embodiment, the collet can comprise a shearable member, the collet being inwardly compressed when the shearable member is intact and the collet experiencing an outward expansion upon shearing of the shearable member.

In at least one embodiment, the collet can comprise an inwardly narrowing element sized to receive the plug member and restrict fluid flow downhole of the received plug member.

In at least one embodiment, the plug member can be a ball.

In at least one embodiment, the at least one inwardly and outwardly biased protuberances comprise a plurality of matching grooves with angled surfaces.

In at least one embodiment, the collet can be manufactured using a degradable material.

In at least one embodiment, the plug member can be manufactured using a degradable material.

In at least one embodiment, the collet and the plug member can be manufactured using a degradable material.

In another aspect, the present disclosure relates to processes for controlling fluid flow in a subterranean well. Accordingly, the present disclosure further provides, in one broad aspect, in at least one embodiment, a process for controlling fluid flow in a wellbore string, the process comprising:

installing a wellbore string having a central bore therethrough and comprising a side-ported tubular valve interconnecting two successive portions of the string, the tubular valve being shiftable from a port closed position to a port open position with at least one opened side port, and having at least one inwardly biased protuberance;

deploying an actuation member directly uphole from the tubular valve in the central bore, the actuation member comprising a tethered receptacle, a plug member that is disposed within the receptacle, and a collet that is coupled to the receptacle with a releasable coupling and has at least one outwardly biased protuberance for correspondingly engaging with the at least one inwardly biased protuberance of the tubular valve and the plug member being engageable with the collet;

releasing the collet from the receptacle; and applying a controlled fluid flow in the central bore to:

engage the plug member with the collet and move the collet and plug member downhole for engaging the tubular valve through the corresponding protuberances and causing the tubular valve to shift from the port closed position to the port open position, and to plug the central bore with the plug member downstream of the port open position thereby directing fluid flow radially through at least one opened side port to a portion of the reservoir formation surrounding the tubular valve.

In at least one embodiment, the controlled fluid can be at least one of water, a stimulation fluid, a proppant slurry, an acid, a base, a produced fluid or a reactive agent.

In at least one embodiment, the wellbore string can be installed in a cased hole wellbore.

In at least one embodiment, the wellbore string can be installed in an open hole wellbore.

In at least one embodiment, the actuation member is deployed directly uphole from the tubular valve by the application of the fluid flow and the fluid flow is substantially reduced to engage the plug member with the collet and move the collet and plug member downhole.

In at least one embodiment, the tethered receptacle can be deployed using a line deployment device and the receptacle can be removed from the wellbore string following release of the collet from the receptacle using the line deployment device.

In at least one embodiment, the wellbore string can comprise a plurality of side-ported tubular valves interconnecting successive portions of the wellbore string and the process comprises deploying the actuation member directly uphole to a final tubular valve that is situated furthest downhole on the wellbore string to thereby direct fluid through at least one side port of the final tubular valve to a portion of the reservoir formation surrounding the final tubular valve.

In at least one embodiment, the wellbore string can comprise a plurality of side-ported tubular valves interconnecting successive portions of the wellbore string and the process comprises:

deploying a first actuation member directly uphole from a first tubular valve to engage the first tubular valve thereby directing fluid radially through at least one side port of the first tubular valve into a first portion of a reservoir formation surrounding the first tubular valve; and thereafter deploying a second actuation member directly uphole from a second tubular valve that is situated uphole from the first tubular valve, to engage the second tubular valve to thereby direct fluid radially through at least one side port of the second tubular valve into a second portion of a reservoir formation surrounding the second tubular valve.

In at least one embodiment, the wellbore string can comprise a plurality of side-ported tubular valves interconnecting successive portions of the wellbore string and the process comprises:

deploying a first actuation member directly uphole from a first tubular valve to shift the first tubular valve to a port open position to direct fluid radially through at least one side port of the first tubular valve to a first portion of a reservoir formation that surrounds the first tubular valve, the first tubular valve being situated uphole from a final tubular valve that is located furthest downhole on the wellbore string.

In at least one embodiment, the wellbore string can comprise a plurality of side-ported tubular valves interconnecting successive portions of the wellbore string and the process comprises:

deploying a first actuation member directly uphole from a first tubular valve to shift the first tubular valve to a port open position and to direct fluid radially through at least one side port of the first tubular valve to a first portion of a reservoir formation that surrounds the first tubular valve, the first tubular valve being located uphole from at least one of the other tubular valves; and thereafter applying additional fluid flow to the central bore to engage a collet from the first actuation member with a second valve downhole from the first valve, the engaging occurring through the corresponding protuberances and causing the second valve to shift from the port closed position to the port open position, and to plug the central bore with a plug member from the first actuation member, thereby directing fluid flow simultaneously through opened side ports in the first and second tubular valves.

Other features and advantages of the present disclosure will become apparent from the following detailed description. It should be understood, however, that the detailed description, while indicating preferred embodiments of the present disclosure, are given by way of illustration only, since various changes and modifications within the spirit and scope of the disclosure will become apparent to those skilled in the art from the detailed description.

BRIEF DESCRIPTION OF THE DRAWINGS

The disclosure is in the hereinafter provided paragraphs described in relation to its figures. The figures provided herein are for illustration purposes and are not intended to limit the present disclosure. Like numerals designate like or similar features throughout the several views possibly shown situated differently or from a different angle. Thus, by way of example only, part 350 in FIG. 5A and FIG. 5B refers to a ball in both of these figures.

Figure 1:
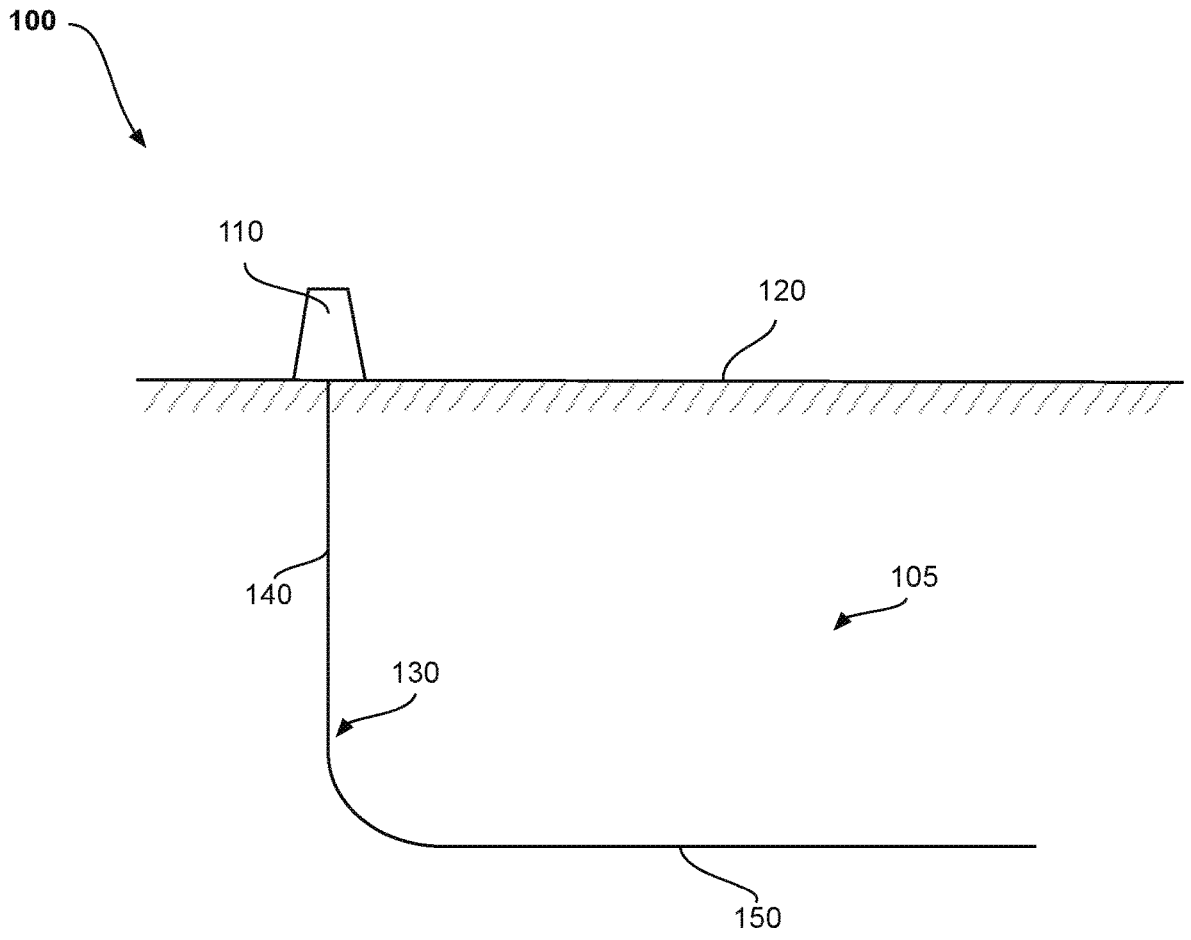
FIG. 1 is a schematic view of an example configuration of a well arrangement.

The figures together with the following detailed description make apparent to those skilled in the art how the disclosure may be implemented in practice.

DETAILED DESCRIPTION OF THE DISCLOSURE

Various apparatuses and processes will be described below to provide an example of an embodiment of each claimed subject matter. No embodiment described below limits any claimed subject matter and any claimed subject matter may cover any apparatuses, assemblies, methods, processes, or systems that differ from those described below. The claimed subject matter is not limited to any apparatuses, assemblies, methods, processes, or systems having all of the features of any apparatuses, assemblies, methods, processes, or systems described below or to features common to multiple or all of the any apparatuses, assemblies, methods, processes, or systems below. It is possible that an apparatus, assembly, method, process, or system described below is not an embodiment of any claimed subject matter. Any subject matter disclosed in an apparatus, assembly, method, process, or system described below that is not claimed in this document may be the subject matter of another protective instrument, for example, a continuing patent application, and the applicants, inventors or owners do not intend to abandon, disclaim or dedicate to the public any such subject matter by its disclosure in this document.

All publications, patents, and patent applications referenced herein are herein incorporated by reference in their entirety to the same extent as if each individual publication, patent, or patent application was specifically and individually indicated to be incorporated by reference in its entirety.

Several directional terms such as "above", "below", "lower", "upper", "inner" and "outer" are used herein for convenience including for reference to the drawings. In general, the terms "upper", "above", "upward", "uphole", "proximal" and similar terms are used to refer to a direction towards the earth's surface along the wellbore, while the terms "lower", "below", "downward", "downhole" and "distal" are used to refer to a direction generally away from the earth's surface along the wellbore. The terms "inner" and "inward" are used herein to refer to a direction that is more radially central relative to the central longitudinal axis of a tubular component, while the terms "outer" and "outward" refer to a direction that is more radially peripheral relative to the central longitudinal axis of a tubular component.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It will be understood that any range of values described herein is intended to specifically include any intermediate value or sub-range within the given range, and all such intermediate values and sub-ranges are individually and specifically disclosed (e.g. 1 to 5 includes 1, 1.5, 2, 2.75, 3, 3.90, 4, and 5). It is also to be understood that all numbers and fractions thereof that are modified by the term "about" are presumed to include a variation of up to a certain amount of the number to which reference is being made if the end result is not significantly changed, such as 10%, for example.

It will also be understood that the word "a" or "an" is intended to mean "one or more" or "at least one", and any singular form is intended to include plurals herein, unless expressly specified otherwise.

It will be further understood that the term "comprise", including any variation thereof, is intended to be open-ended and means "included, but not limited to", unless otherwise specifically indicated to the contrary.

In general, the downhole assembly of the present disclosure can be used to operate a well in a reservoir of hydrocarbons. Notably, the assembly of the present disclosure permits control of the flow path of fluids in a well. In particular, the tool assembly can be used to establish fluid communication between defined sections within a wellbore and portions of a hydrocarbon reservoir formation surrounding these sections.

In broad terms, the tool assembly comprises a wellbore completion string interconnected by one or more shiftable valves and at least one valve actuation member that can shift the valves from a port closed position to a port open position. The herein provided tool assembly permits deployment of the valve actuation member to a precisely known location within a wellbore completion string. The location can be in close proximity to a shiftable valve which is desired to be opened. One disadvantage of known collet based shiftable valve systems is that once a collet is deployed from the surface into the completion string, its exact location within the string is not known. Therefore, it can be challenging for operators to control fluid flow rates in a manner that allows rapid migration of a collet through the completion string to reach a specific valve, and thereafter engage with the valve. The application of insufficient fluid flow leads to operational inefficiencies. Conversely, as hereinbefore noted, when excessive fluid flow is applied a collet can fail to connect with the matching sleeve to open a port. Identifying the location of the collet and the conduct of remediation activities to open the shiftable sleeve can require extensive equipment operation from surface.

By contrast, the assembly of the present disclosure can initially migrate through the wellbore string using high fluid flow rates thus allowing the assembly to rapidly reach its desired location near a shiftable valve. Final engagement with the shiftable valve can then take place at a substantially lower fluid flow rate, substantially limiting instances of failure to open the valve. Thus, the assembly of the present disclosure can rapidly be deployed. Therefore, the herein disclosed assemblies provide a well operator with tight control of the opening of each shiftable valve in a wellbore string, limits the unintentional opening of shiftable valves, and limits interference with the intended stimulation sequence of formation zones in multistage completions. In at least some embodiments, the tool assembly comprises a single actuation member capable of opening multiple shiftable valves. This feature of the tool assembly of the present disclosure limits the amount of fluid flow impeding structures (i.e. ball seats) within the completion string and obviates the need for drilling out the ball seats prior to production flowback, thereby improving hydrocarbon recovery. Furthermore, this feature permits the performance of single and limited entry operations.

Example embodiments are hereinafter described with reference to the drawings.

Referring to FIG. 1, shown therein is an example well arrangement 100 for fracturing an oil or gas reservoir formation 105. A rig 110 is set up at surface 120 for operating well 130. Rig 110 can initially be a drilling rig and can later be replaced with a service rig, such as a fracturing rig, at selected times. For simplicity, any type of surface rig or tool deployment rig, including a mobile rig, such as a truck, can be represented by rig 110.

Well 130 comprises a vertical well section 140 and a horizontal well section 150. In operation, rig 110 can be used to apply fluids, for example, stimulation fluids, through the vertical section 140 of the well 130 to the reservoir formation 105 surrounding the horizontal section 150 of the well 130. The tool assemblies of the present disclosure can be deployed from rig 110, and permit control over the direction of fluid in the well 130, including direction of the fluid in the horizontal section 150 of well 130 and selected portions of reservoir formation 105.

Figure 2A:
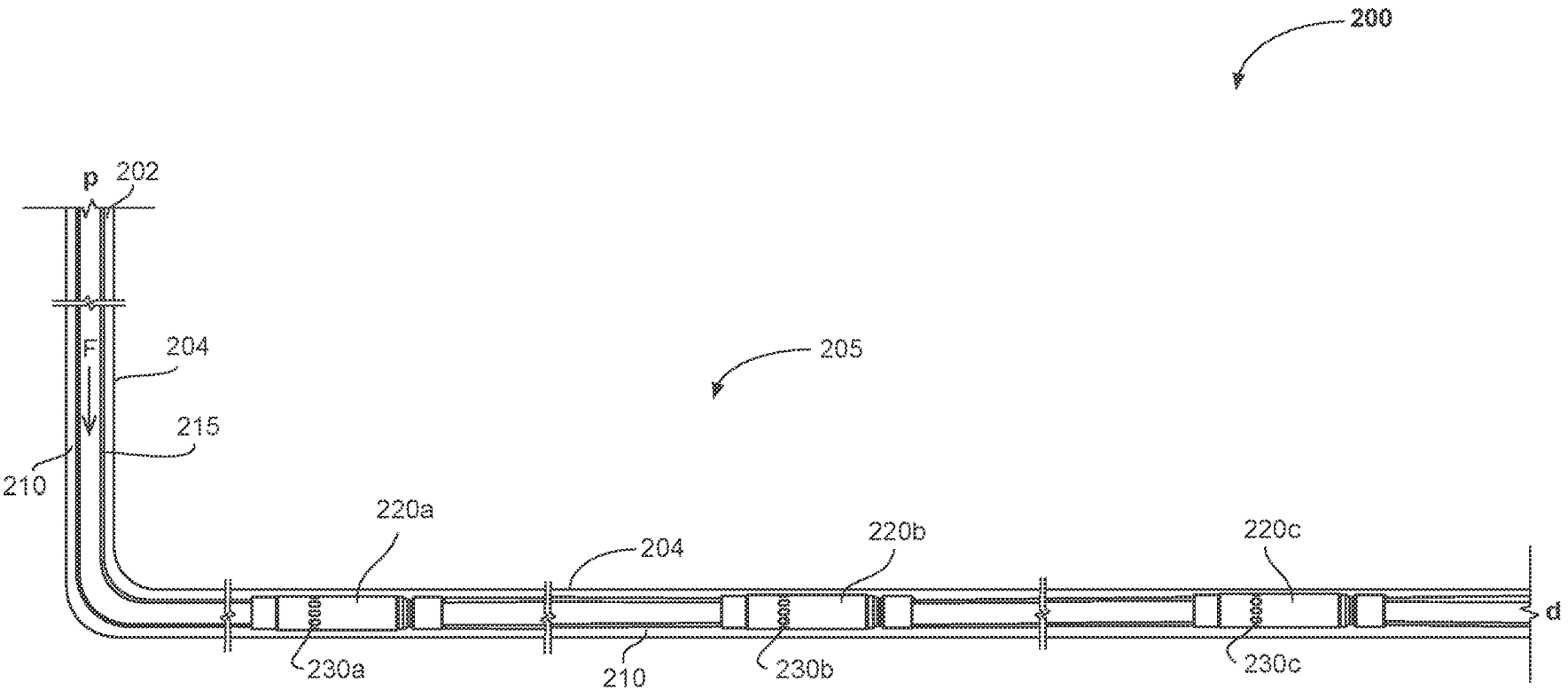
FIGS. 2A and 2B are schematic views of two example configurations of a portion of a well arrangement, namely a cased hole (cemented) well arrangement (FIG. 2A) and an open hole well arrangement (FIG. 2B).
Figure 2B:
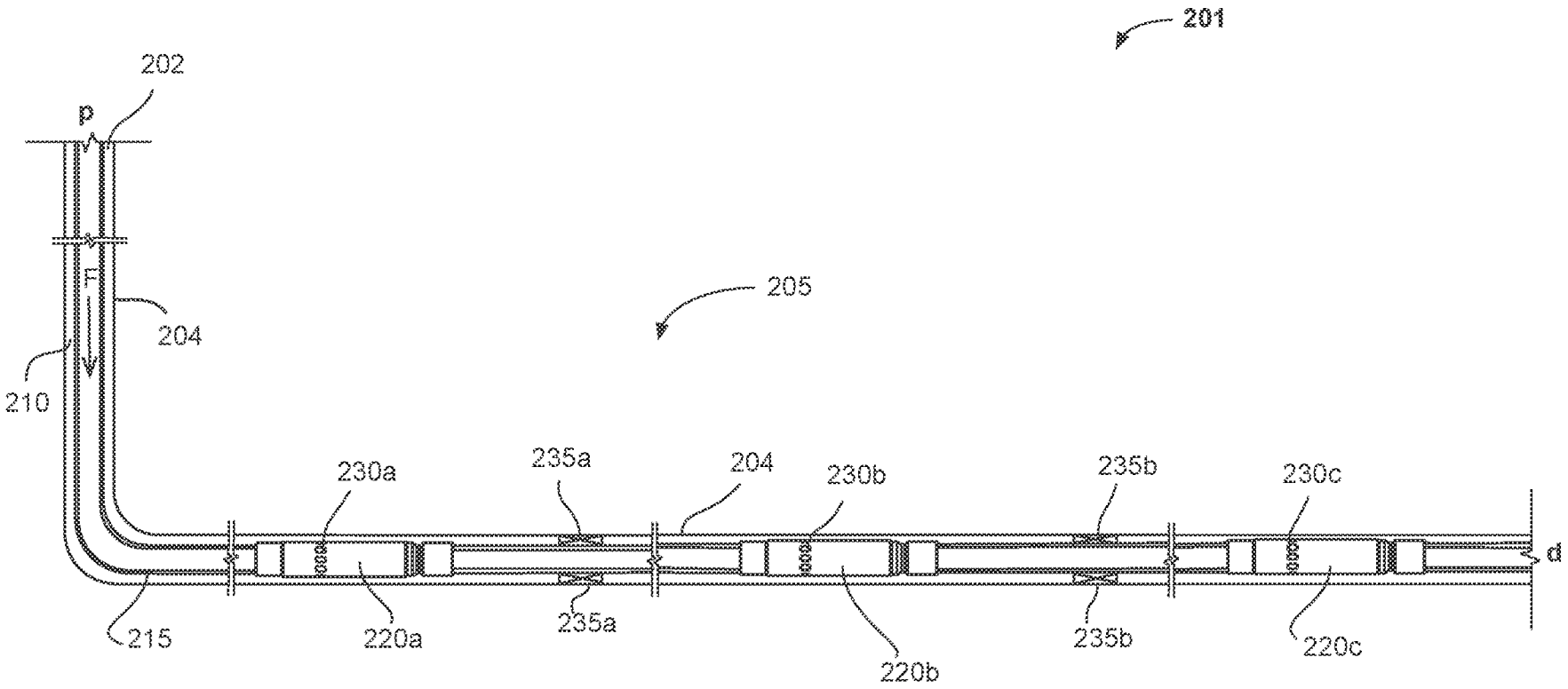

Referring now to FIG. 2A and FIG. 2B, shown therein in further detail (relative to FIG. 1), is a portion of two example well arrangements 200 (FIG. 2A) and 201 (FIG. 2B) for fracturing an oil or gas reservoir formation. FIG. 2A represents a cased hole, or cemented, wellbore system 200 and FIG. 2B represents an open hole wellbore system 201. The shown portion of the wellbore systems 200 and 201 each comprise a wellbore 202 defined by a wellbore wall 204 drilled into reservoir formation 205 and having a proximal end p extending to the surface (not shown), and a distal end d extending to the end (not shown) of wellbore 202. Tubular string 215 inserted in wellbore 202 forms an axially extending annulus 210 between wellbore wall 204 and tubular string 215. In open hole wellbore system 201, annulus 210 is filled with fluid during fluid treatment of reservoir formation 205, while in cemented wellbore system 200, prior to the initiation of fluid treatment of reservoir formation 205, annulus 210 is filled with cement. Wellbore 202, or certain sections thereof, can in certain embodiments, be lined with casing (not shown), in which case annulus 210 can be formed between tubular string 215 and the casing.

Tubular string 215 includes a plurality of spaced apart shiftable tubular valve assemblies 220*a*, 220*b*, and 220*c*, (of which the exterior view is shown in FIG. 2A and FIG. 2B). Each assembly 220*a*, 220*b*, and 220*c* comprises several side ports that are collectively indicated by 230*a*, 230*b*, and 230*c*, respectively, and can be opened to allow fluid communication between fluid in tubular string 215 via annulus 210 with reservoir formation 205. As is known to those of skill in the art, side ports can be implemented in various ways. In general, side ports are apertures in the wall of a tubular valve allowing for fluid communication between the central passage of the tubular valve and the exterior of the tubular valve. In different embodiments, the number of side ports can vary. For example, shiftable valves have at least one side port, for example, such as 1, 2, 3, 4, 5, 6, 7, 8, 9, 10 or more side ports. Furthermore, the geometry of the side ports can vary. Side ports can, for example, have an oval shape, or a round shape. A source to provide fluid and control fluid circulation can be set up at proximal end p extending to the surface of the well 130 so that fluid can migrate through tubular string 215, as indicated by arrow F towards distal end d of tubular string 115, whence fluid can flow into annulus 110. Although three shiftable tubular valve assemblies 230*a*, 230*b*, and 230*c* are shown, more or less tubular valve assemblies may be used in practice. Thus, in some embodiments, 10, 20, 30, 40, 50 or more tubular valve assemblies may be used.

It is noted that in well assembly 201, in addition to shiftable valve assemblies 220*a*, 220*b* and 220*c*, tubular string 215 of the wellbore system further comprises several packers 235*a* and 235*b*, capable of sealing annulus 210 between tubular string 215 and wellbore wall 204, spaced between valve assemblies 220*a*, 220*b* and 220*c*. As will be appreciated by those skilled in the art, packers and valve assemblies can be spaced in any way relative to one another to achieve a desired interval length or number of ports per interval. In addition, well assemblies for multistage stimulation can include several other operational devices, including, for example, cementing tools (not shown), and/or a wellbore isolation valve (not shown), as is known by those skilled in the art.

In general, valve assemblies 220*a*, 220*b*, and 220*c* are deployed within tubular string 215 to control fluid flow therethrough. In particular, valve assemblies 220*a*, 220*b* and 220*c* can be deployed to control the opening of the ported intervals through tubular string 215 and are each operable from a port closed position, covering its associated interval, to a port open position wherein fluid flow of, for example, a fracture fluid, is permitted through the ports of the corresponding ported intervals. In general, valve assemblies 220*a*, 220*b*, and 220*c*, can be actuated by a corresponding actuation member of the tool assembly of the present disclosure causing one or more of valve assemblies 220*a*, 220*b*, and 220*c* to shift from a port closed position to a port open position. An actuation member that corresponds to a given valve assembly is meant to be used to actuate the given valve assembly. Alternatively, in some embodiments, a single actuation member can open a plurality of valves in a wellbore string. Alternatively, in other embodiments, a first actuation member can open a first valve in a wellbore string, and a second actuation member can open a second valve in a wellbore string and so on and so forth for additional actuation members and corresponding valves. Once in a port open position, fluid can flow through the port to annulus 210 and contact reservoir formation 205.

Tubular string 215, including valve assemblies 220*a*, 220*b*, and 220*c*, and optionally other operational devices, can be run in and installed in wellbore 202 typically with each of valve assemblies 220*a*, 220*b*, and 220*c*, in a port closed position. Valve assemblies 220*a*, 220*b*, and 220*c*, can be shifted into their port open position when tubular string 215 is ready for use and ready for stimulation fluid treatment of reservoir formation 205.

It should be clearly understood that the valve assembly and methods of the present disclosure are not limited in any way to use in conjunction with the example well arrangements 100, 200 and 201 shown in FIG. 1, FIG. 2A and FIG. 2B, respectively. On the contrary, other wellbore arrangements having a requirement for directing fluid in a wellbore can be constructed, and at least one tool assembly of the present disclosure and at least one process of the present disclosure can be used in conjunction with a wide variety of wellbore arrangements and configurations.

According to one embodiment of the present disclosure, well arrangements, such as well arrangements 100, 200 and 201, can, in one example embodiment, be operated as illustrated in FIGS. 3A-3F.

Figure 3A:
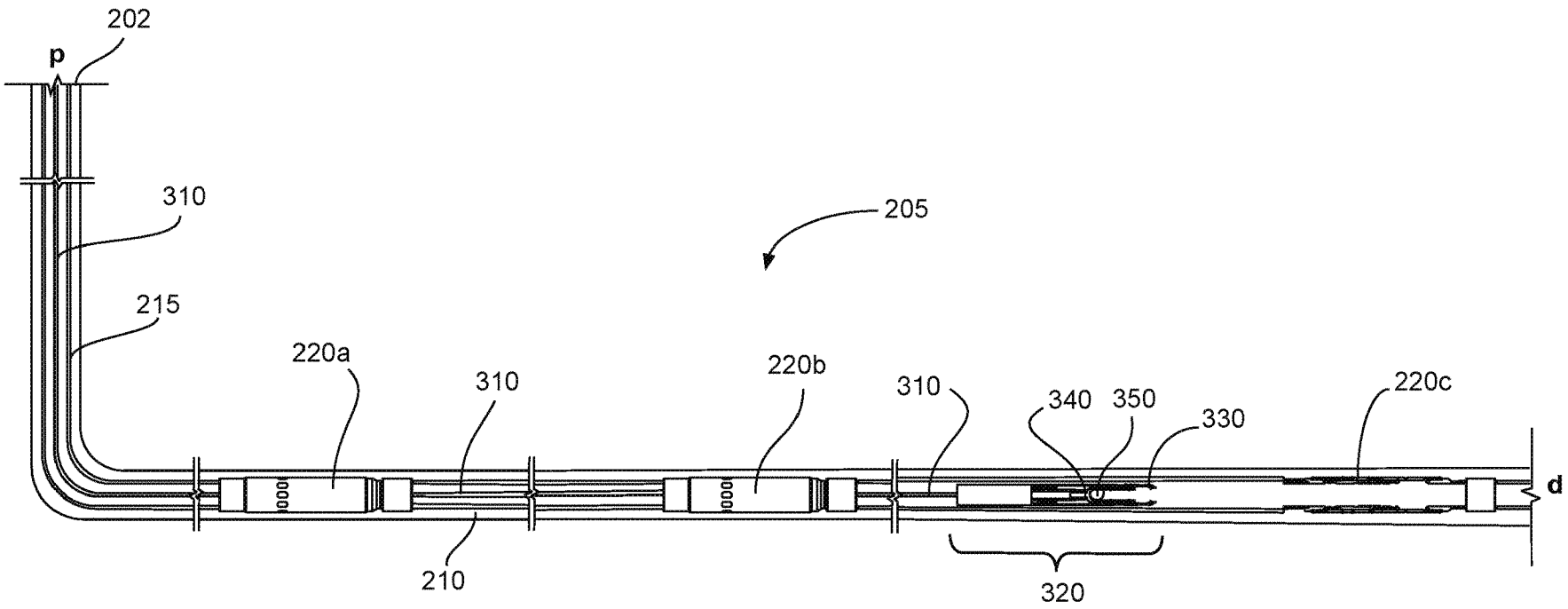
FIGS. 3A, 3B, 3C, 3D, 3E and 3F are schematic views, illustrating a process for operating a well.

As shown in FIG. 3A, initially wellbore liner 215 comprising shiftable valves 220*a*, 220*b* and 220*c* can be run into wellbore 202 within reservoir formation 205 and installed, to achieve, for example, a well arrangement as depicted in FIG. 2A. In an embodiment, the downhole depth location of shiftable valves 220*a*, 220*b* and 220*c* within the well, relative to surface 120, can generally be established by measuring the length of the section of wellbore liner between a valve and surface 120. It is noted that side views of shiftable valves 220*a* and 220*b* are shown, while a cross section of shiftable valve 220*c* is shown.

Next, actuation member 320 can be deployed from surface 120 through wellbore liner 215 by line 310. In some embodiments, line 310 can be a slickline or coiled tubing. In other embodiments, line 310 can be a wireline or electric line (e-line).

Line 310 can be deployed from the surface 120 using a line deployment device, for example, a reel or a drum, which can be operated and controlled at the surface 120, for example, from a rig (not shown). Line 310 can migrate in a downhole direction through wellbore liner 215 until it is lowered to a depth in which it is in uphole proximity of the shiftable valve with which the actuation member corresponds with and is intended to interact with, here depicted as shiftable valve 220*c*. As line 310 migrates downhole through wellbore liner 215, it can pass through one or more shiftable valves without actuatable interaction with these valves, here depicted as shiftable valves 220*a* and 220*b*. Thus, actuation member 320 can, in a run-in position, be located downhole from one or more shiftable valves. Relatively high fluid flows can be applied at this stage to facilitate downhole migration of actuation member 320, for example, from about 60 meters/min to about 90 meters/min.

Actuation member 320 comprises collet 330, receptacle 340 and ball 350. Receptacle 340 is tethered to surface 120 by line 310. A plug member, which in this example embodiment is the ball 350, is disposed within receptacle 340. Receptacle 340 is releasably coupled to collet 330. Collet 330 is generally situated downhole relative to the receptacle 340. The plug member is in contact with receptacle 340. No coupling structure connects plug member to receptacle 340, or plug member to collet 330. Thus, in this initial configuration, collet 330 is coupled via receptacle 340 to line 310 deployed from surface 120. It will be appreciated by those of skill in the art that instead of ball 350, other plug members can be used that have other geometrical shapes, e.g. a cone or a cylinder.

The details of receptacle 340 and collet 330 and their operation will be further described below (see: FIGS. 4A to 8D). Suffice it to note at this point that the location of actuation member 320 within wellbore liner 215 can be determined with a substantial degree of accuracy, for example, by monitoring and measuring at surface 120 the length of line 310 deployed into wellbore liner 215. Thus, actuation member 320 can be positioned within close uphole proximity of shiftable valve 220*c* with which collet 330 is intended to interact. For example, actuation member 320 can be positioned within one or two liner joints, or, for example, approximately, within less than about 24 meters uphole from shiftable valve 220*c*, or from about 24 meters to about 12 meters, uphole from shiftable valve 220*c*.

Figure 3B:
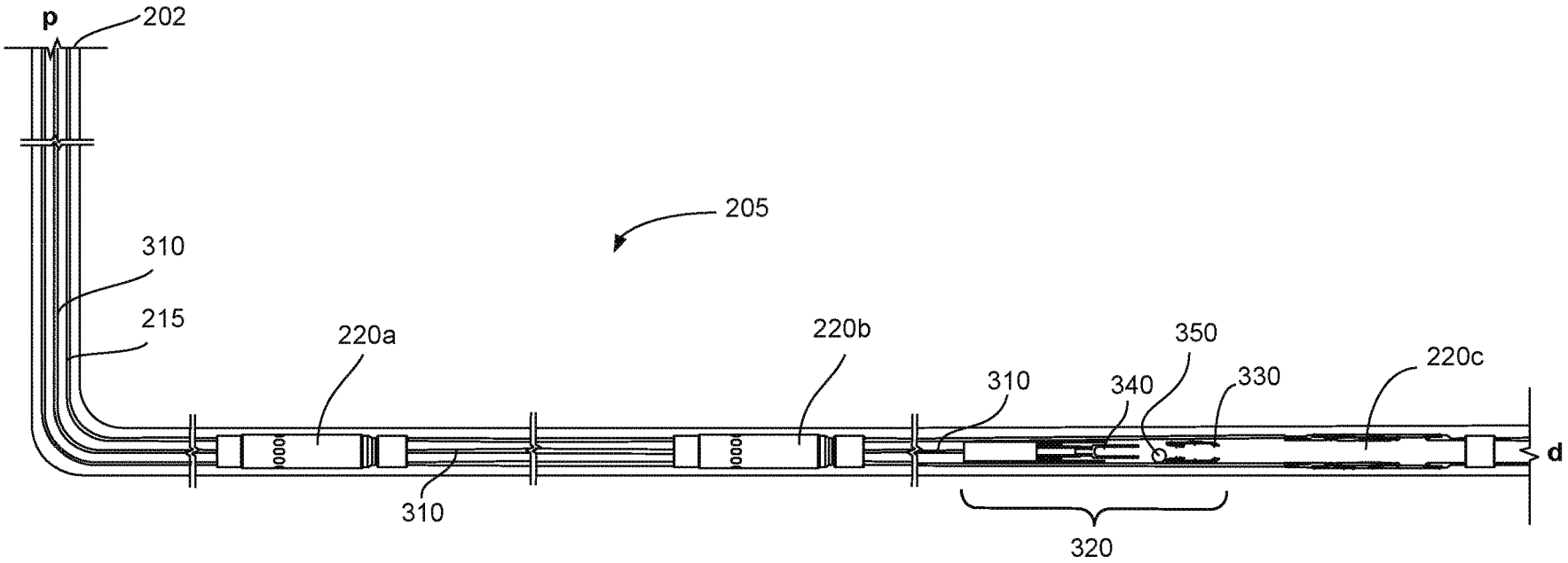

As shown in FIG. 3B, next, receptacle 340 is uncoupled and separated from collet 330. The uncoupling results in the untethered collet 330 within wellbore liner 215 being located downhole from tethered receptacle 340. Ball 350 is also separated from receptacle 340, and further can also be separated from collet 330 within wellbore liner 215. Release of collet 330 from receptacle 340 can be controlled from surface 120, for example, electrically in embodiments in which a wire line is used, or pressure-actuated when coiled tubing is used, using standard setting tools known to those of skill in the art.

Figure 3C:
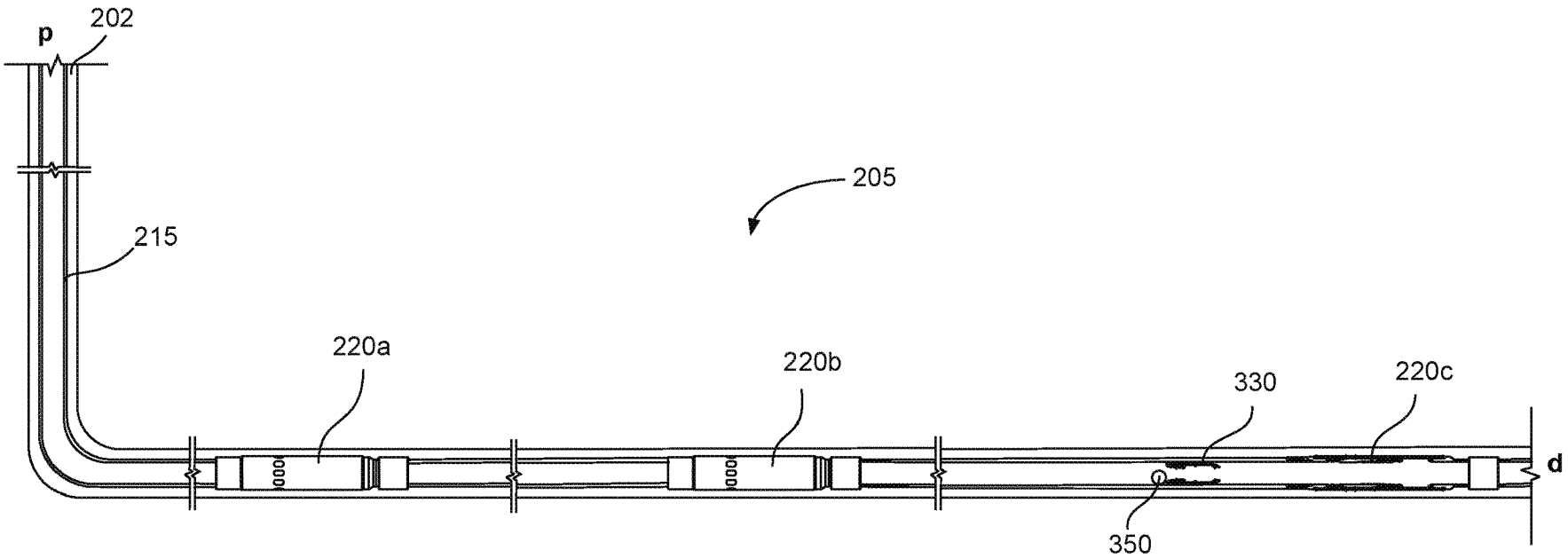

Once collet 330 is released, line 310 and receptacle 340 tethered thereto can be pulled from surface 120 out of wellbore liner 215, to thereby achieve the configuration depicted in FIG. 3C. It is noted that collet 330 and ball 350 remain situated in close uphole proximity to shiftable valve 220*c*.

Figure 3D:
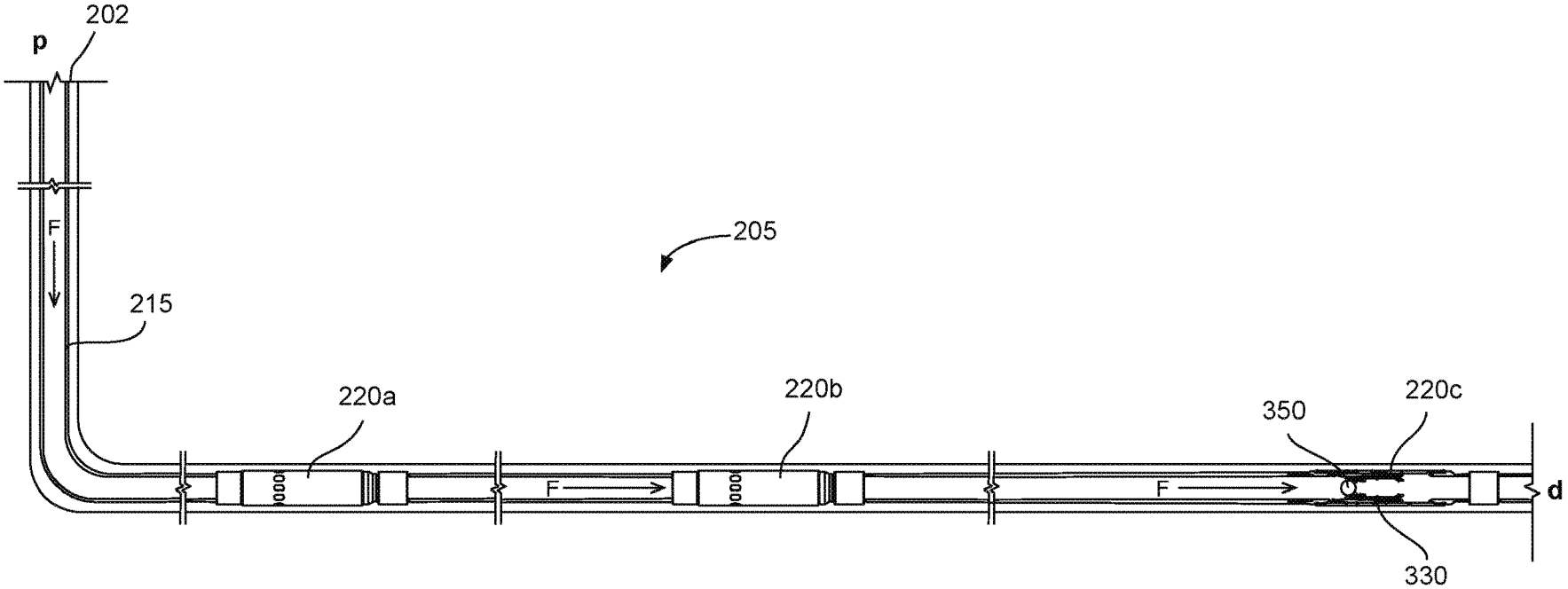

As shown in FIG. 3D, next, fluid (F) can be injected into wellbore liner 215 from surface 120. Fluid flow rate applied at this stage can be controlled from surface 120 to be modest, for example, equal to or less than about 2 $m^3$/min, for example from about 0.5 $m^3$/min to about 2 $m^3$/min Thus, engagement between collet 330 and valve 220*c* can be controlled, and the risk of collet 330 proceeding downhole without opening valve 220*c* can be minimized. The injection of fluid (F) results in ball 350 contacting and engaging with collet 330 and the joint downhole migration of collet 330 and ball 350 until collet 330 engages with shiftable valve 220*c* in a manner which causes valve 220*c* to shift from a port closed position to a port open position. Furthermore, engagement of ball 350 with collet 330 blocks the central bore of wellbore liner 215. This prevents fluid communication between sections of wellbore liner 215 that are situated uphole and downhole of ball 350, respectively, thus isolating these uphole and downhole sections of the well. The details of the interaction between collet 330 and shiftable valve 220*c* are hereinafter further described (see: FIGS. 8A to 8E).

Figure 3E:
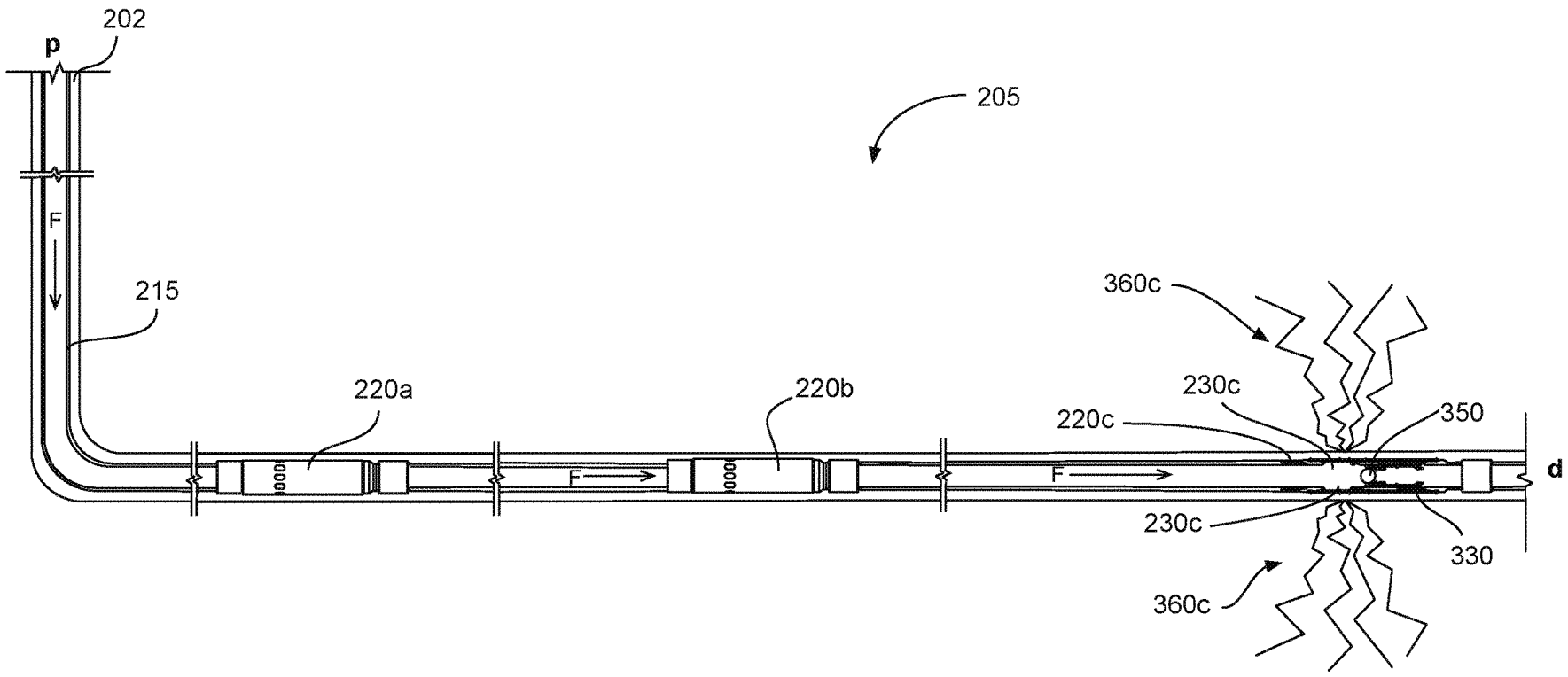

As shiftable valve 220*c* is in a port open position and ball 350 blocks a fluid path downhole from ball 350 through the bore of wellbore liner 215, fluid injected into wellbore liner 215 from surface 120 can follow along a fluid path F downhole through wellbore liner 215, to then exit wellbore liner 215 through side ports 230*c* of shiftable valve 220*c*. Thus, this establishes fluid communication between wellbore liner 215 and a zone of reservoir formation 205 surrounding shiftable valve 220*c*. By applying fluid, for example fracturing fluid, at sufficient pressure, portion 360*c* of reservoir formation 205 surrounding shiftable valve 220*c* can be fractured, as is shown in FIG. 3E.

Figure 3F:
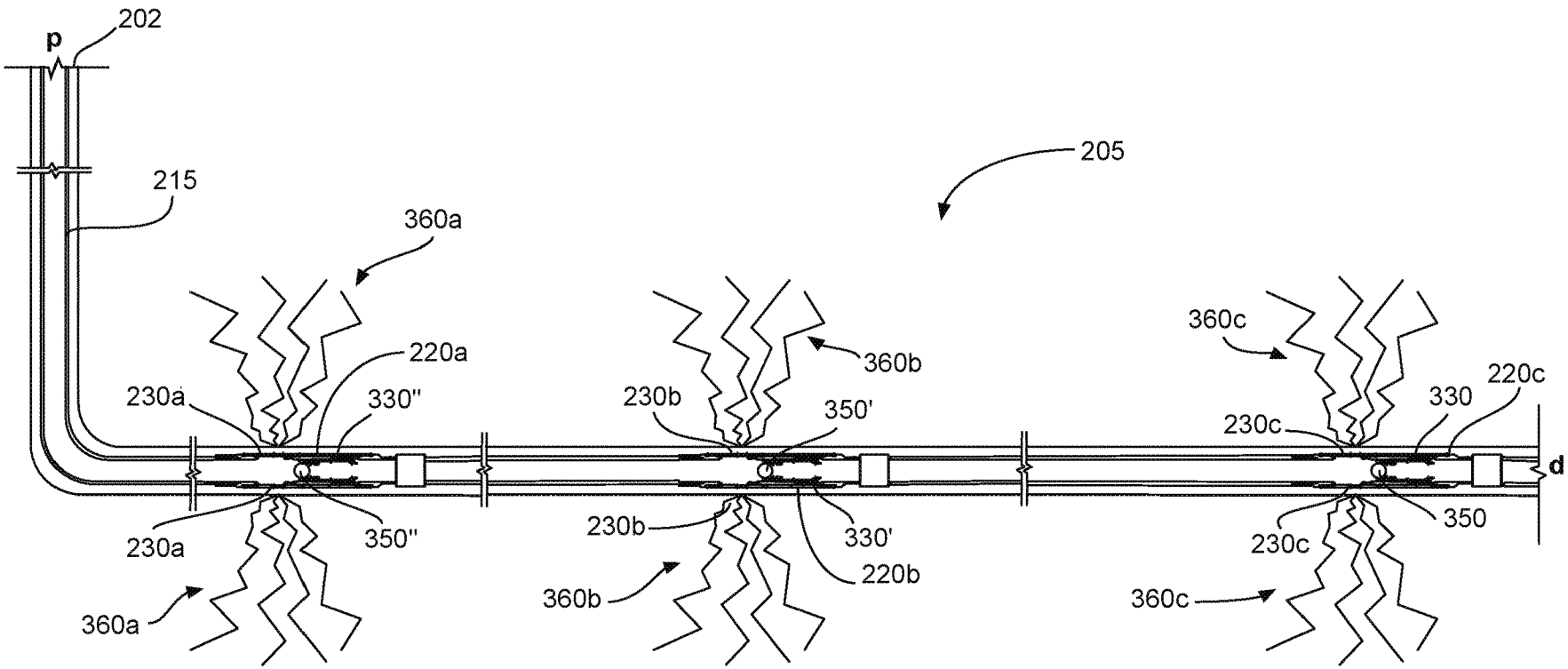
Figure 4A:
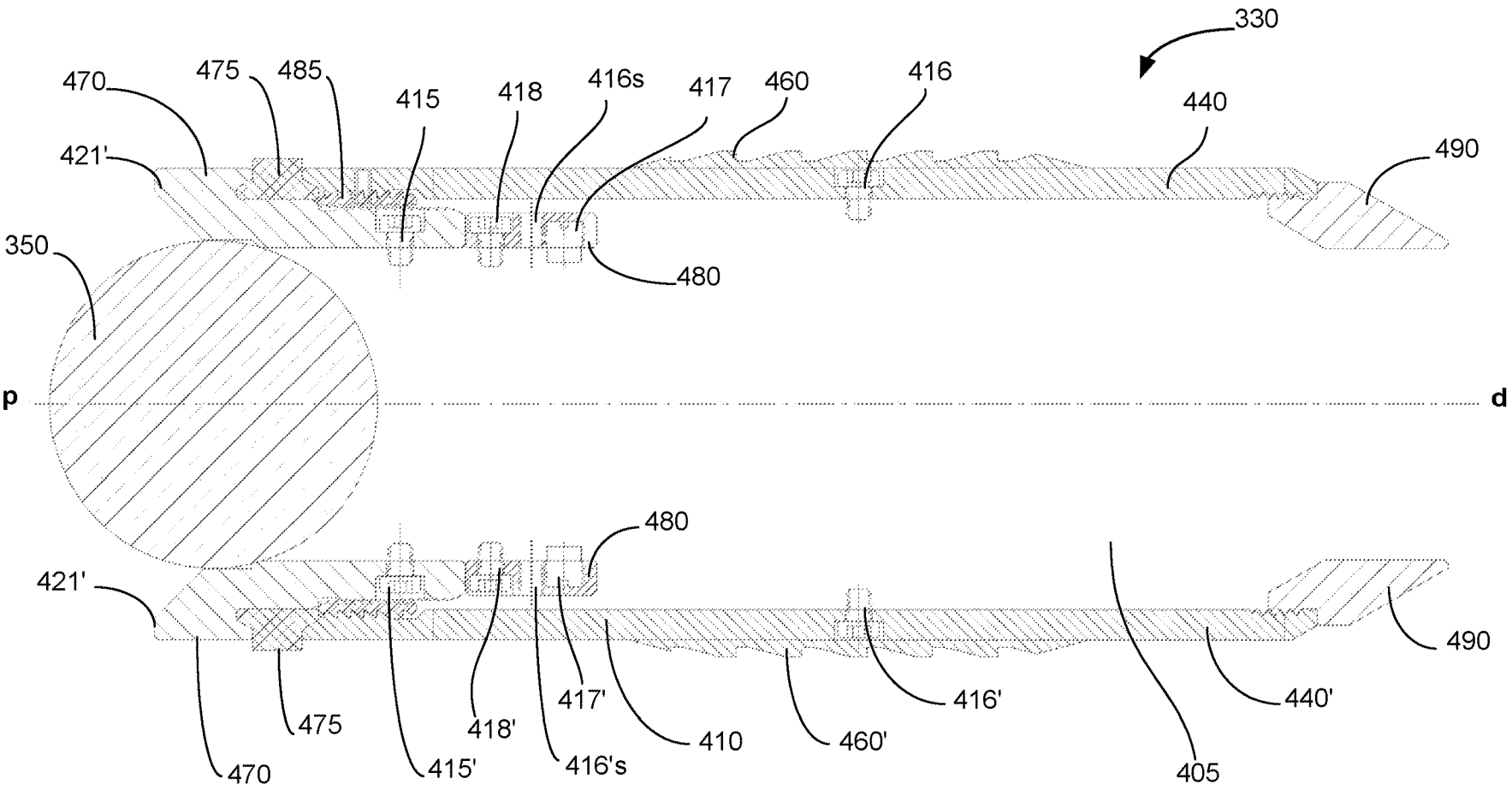
FIGS. 4A and 4B are cross-sectional views of a collet with a ball, and a receptacle, respectively.
Figure 4B:
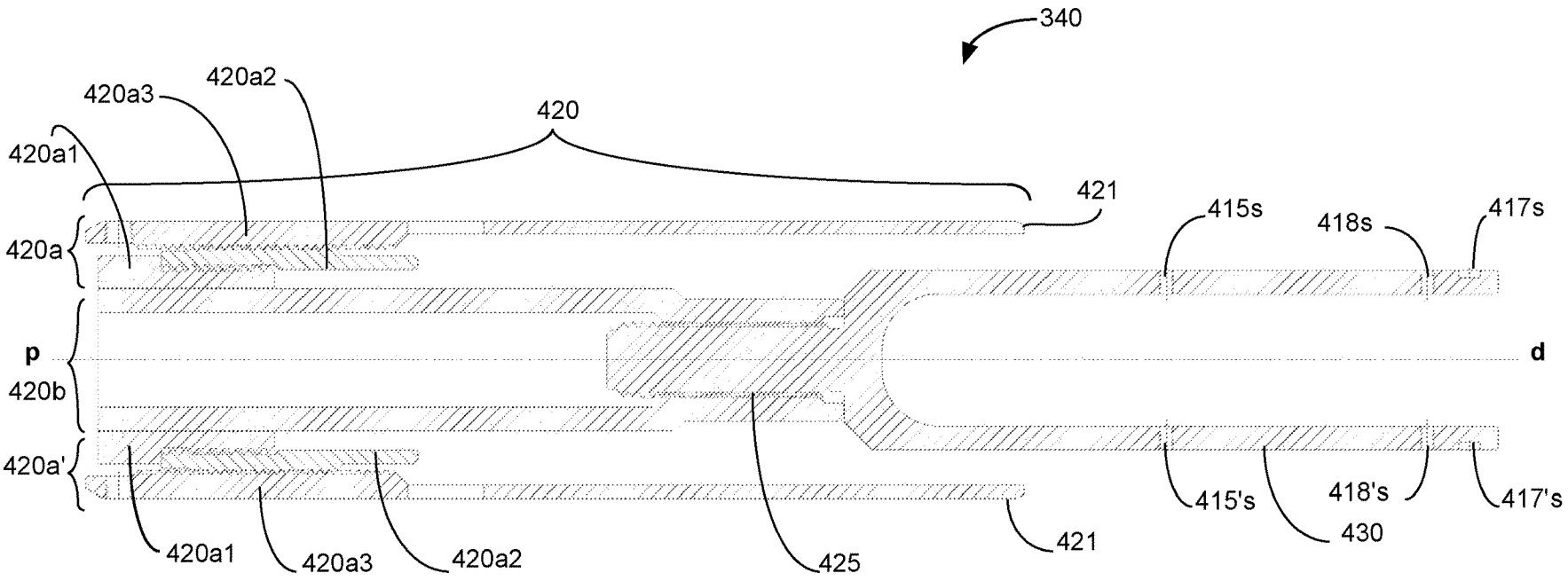

Referring now to FIG. 3F, after a phase of fracturing through shiftable valve 220*c*, a line comprising an additional actuation member (not shown), comprising additional collect 330' and additional plug member 350', can be deployed but this time to a well depth that permits actuation of a shiftable valve, such as shiftable valve 220*b*, that is upstream of the last actuated shiftable valve (i.e. shiftable valve 220*c*). Upon engagement of additional collet 330' and additional ball 350' with shiftable valve 220*b*, the wellbore section uphole from shiftable valve 220*b* is isolated from the wellbore section downhole of shiftable valve 220*b*. Furthermore, fluid communication can be established between the wellbore liner 215 and a portion 360*b* of the reservoir formation 205 surrounding valve 220*b*. Portion 360*b* of reservoir formation 205 can then be fractured by applying fluid, at sufficient pressure, to portion 360*b* of the reservoir formation 205 surrounding shiftable valve 220*b*. Following a phase of fracturing through shiftable valve 220*b*, the hereinbefore described process can be repeated a third time to fracture portion 360*a* of the reservoir formation 205 through shiftable valve 220*a* using a third collet 330" and a third ball 350". It is noted that in some embodiments, balls 350, 350' and 350" can be equal in size. Notably in embodiments wherein identical collets are used, the balls are generally the same size. Identical collets can be used when the position of the shiftable valves 220*a*, 220*b* and 220*c* within the wellbore liner 215 is known, so that the actuation member 320 can be deployed and positioned in close uphole proximity of a desired valve 220*a*, 220*b* or 220*c*. This can be achieved, for example, by tracking and measuring the migration distance of line 310 through wellbore liner 215 upon initial deployment of the actuation member 310 at surface 120. In other embodiments, differently sized balls can be used; however, in general this requires the use of non-identical collets to ensure that the valve ball seat matches with the balls.

To briefly recap, in a process, according to at least one embodiment of the present disclosure, a wellbore string having a central bore therethrough is installed. The wellbore string comprises a side-ported tubular valve interconnecting portions of the string that are upstream and downstream from the tubular valve. The tubular valve is to be shifted from a port closed position to a port open position and is currently in the port closed position. A tethered actuation member is deployed directly uphole from the tubular valve in the central bore. The actuation member comprises a receptacle, a plug member and a collet. The plug member is disposed within (i.e. is included) the receptacle but is unengaged with the receptacle. The receptacle is coupled to the collet through a releasable coupling. The collet is released directly uphole from the tubular valve. Fluid flow is then applied in the central bore to engage the plug member with the collet, and to move the collet and plug member while engaged downhole. The collet then engages with the shiftable valve. This engagement causes the shiftable valve to shift from the port closed position to the port open position, and also to plug the central bore with the plug member. In a port open position, a fluid path through the opened side ports of the tubular valve to the surrounding reservoir formation 205 is established.

Other operational embodiments are conceived and will hereinafter be detailed. However, before turning to these embodiments, details of the actuation member and interaction of the collet with the shiftable valves will be described.

Figure 5A:
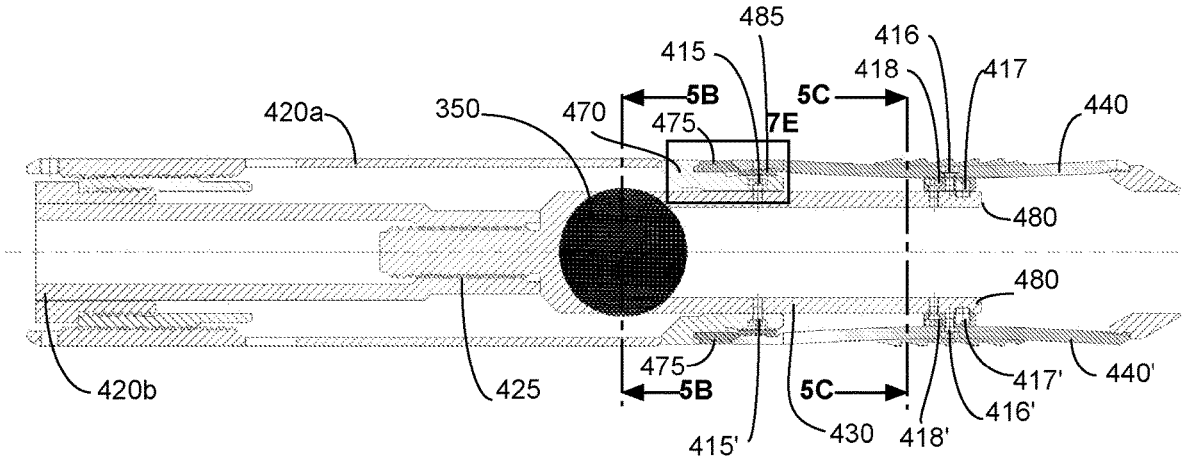
FIG. 5A is a longitudinal cross-sectional view of a collet with a ball and a receptacle.
Figure 5B:
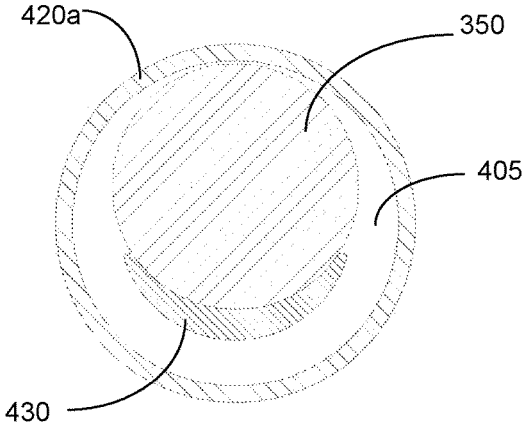
FIGS. 5B and 5C are cross sectional views taken along the lines 5B-5B and 5C-5C, respectively, as denoted in FIG. 5A.
Figure 5C:
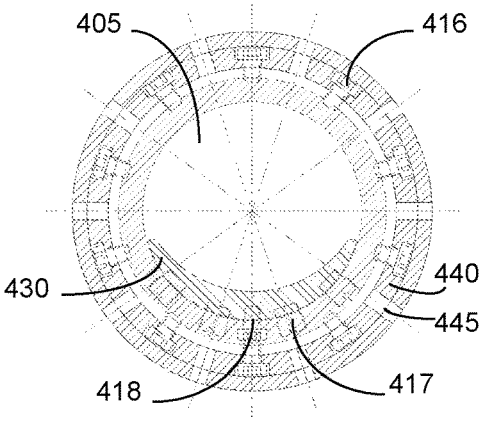

As depicted in FIGS. 4A-5C, an example embodiment of the downhole assembly of the present disclosure includes collet 330 having tubular body 410 and a plurality of distally extending collet fingers 440, 440' defining a channel 405. Only collet fingers 440, 440' are shown for ease of illustration. Collet fingers 440, 440' are generally rectangularly shaped, are circumferentially distributed about collet 330 and are separated by a plurality of interdigital spaces 445 (FIG. 5C). Collet 330 further comprises an inwardly narrowing element sized to receive a plug member and is disposed at a proximal end portion thereof. For example, the inwardly narrowing element can be a ball seat 470. Collet 330 is initially releasably coupled and secured in place to tethered receptacle 340 (tether not shown) by one or more shearable members notably, in the shown embodiment, groups of shear pins, each group containing one or more shear pins (415, 415'), (416, 416'), (417, 417'), and (418, 418'). It is noted that two portions of matching sheared shear pins are numerically represented as n and ns where n is a number such as, for example, 417 and 417*s*, or 415' and 415's. In some embodiments, some shear pin groups can be mounted to a spacer, for example a ring-shaped spacer, that is freely axially moveable within collet 330 upon shearing of the shear pins. Thus, for example, shear pins (417, 417'), and (418, 418') are mounted to a ring-shaped spacer 480 which can freely move within collet 330 upon shearing of the shear pins (416, 416'; 417, 417' and 418, 418'). In some embodiments, shear pins can be used to inwardly compress collet fingers 440, 440'. Thus, for example, shear pins (416, 416'), which are attached to ring-shaped spacer 480, provide for initial inward compression of collet fingers 440, 440'. The inward compression can be released upon shearing of shear pins (416, 416'), as further shown in FIGS. 7A and 7B. Collet 330 also comprises an outwardly extending sealing member 475 operably connected to a ratchet 485 and shear pins 415 and 415'. The operation of sealing member 475 during use is further detailed in FIGS. 7A, 7E, 7F and 8E.

In some embodiments, ball 350 and/or collet 330, or portions thereof, for example, ball seat 470, can be fabricated from degradable materials. Degradable materials are materials that are reactive to one or more reactive fluids, including but not limited to, for example, at least one of water, a completion fluid, a stimulation fluid, a proppant slurry, an acid, a base, a produced fluid, a reactive fluid agent, and the like in a manner that results in degradation of the materials in a time period that is substantially shorter than the time period in which other components may degrade, perhaps naturally. However, the shiftable valves are desired to be permanent. Degradable materials can include without limitation, for example, polyvinyl alcohol-based polymers, polyglycolic acid, polylactide polymers, alloyed materials such as aluminum or magnesium, or combinations of any of the foregoing. Thus, for example, in some embodiments, a degradable material can be selected so that collet 330 can be degraded when exposed to a reactive fluid within a desired time period, such as less than about 1 year, less than about 6 months, less than about 3 months, less than about 1 month, less than about 2 weeks or less than about 1 week following initial exposure to reactive fluids. In general, these embodiments permit an increase in the inner diameter of shiftable valve 220 and a reduction in obstruction of fluid flow through wellbore liner 215. Thus, upon completion of a fracturing operation, and degradation of collet 330 and/or ball 350, hydrocarbons can be efficiently recovered.

One or more of collet fingers 440 and 440' further comprise outwardly biased grooved protuberances, 460 and 460' and each collet finger 440, 440' comprises inward tapering ring-shaped guiding element 490 projecting downhole from collet fingers 440, 440'. Guiding element 490 can facilitate central entry of collet 330 into valves 220. Ball 350 is initially disposed within a distally extending receiving member, for example, a concavely curved axially extending receiving member 430 of receptacle 340. Receiving member 430 is attached at its proximal end, for example, through a screw-threaded coupling 425, to setting tool 420 of receptacle 340. Setting tool 420 comprises moveable components 420*a* and 420*b* that can slideably move in the axial direction relative to each other, as more clearly shown in FIGS. 7A to 7C. Movable component 420*a* comprises sliding member 420*a*1, ring-shaped coupling member 420*a*2 and downhole distally extending tubular pressure member 420*a*3. Actuation of setting tool 420, for example, electrical or hydraulic actuation, results in movement in the axial direction of moveable component 420*a* relative to moveable component 420*b*, and the exertion of pressure in the longitudinal axial direction through distal surface 421 of pressure member 420*a*3 on corresponding inner surface 421' of collet 330, as more clearly shown in FIGS. 7A to 7C. Guiding element 490 can act as a stop to prevent ball 350 that is located downhole from shiftable valve 220 from migrating uphole from a downhole collet, as shown in FIG. 9B. Details of release of receptacle 340 from collet 330 are further illustrated in FIG. 5A, and FIGS. 7A to 7F.

Figure 6A:
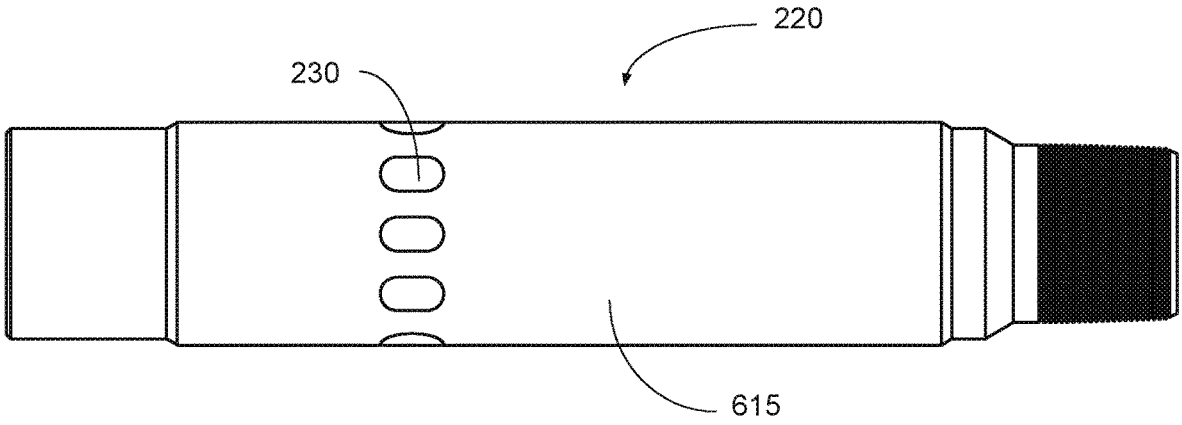
FIGS. 6A and 6B are an elevated side view and a cross-sectional view, respectively, of a shiftable valve.
Figure 6B:
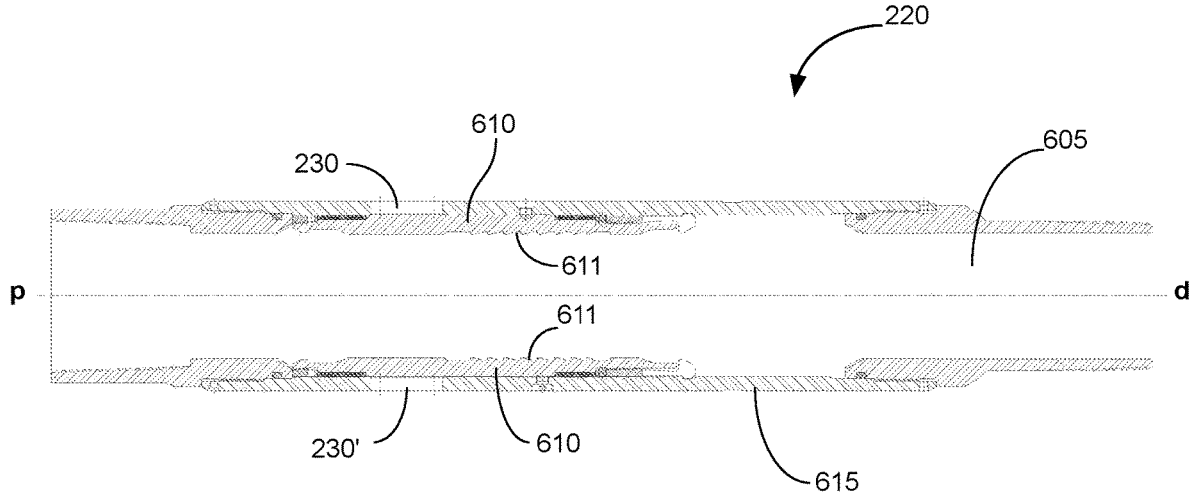

Turning now to the shiftable valve 220 and referring to FIGS. 6A and 6B, shown therein is tubular shiftable valve 220 comprising housing 615 with channel 605 axially formed therethrough. Shiftable valve 220 comprises shiftable element 610 comprising inwardly biased grooved protuberance 611. Different grooved protruding structures can be implemented. The shiftable valve 220 comprises at least one inwardly biased grooved protuberance 611, and the collet 330 comprises at least one matching outwardly biased grooved protuberance 460. Furthermore, by varying the grooved protruding structures, engagement under different fluid pressures can be controlled. Thus, for example, the number of individual grooves in a grooved protruding structure can be varied, and grooved protruding structures can comprise, for example, from 3 to 20 individual grooves. The geometry of grooved protruding structures can also be varied. The geometry of individual grooves in a grooved protruding structure can be identical or different from one another. In one embodiment, the grooved protruding structure on inwardly biased grooved protuberance 611 can comprise a threaded helical profile, and the outwardly biased protuberance on collet fingers 440, 440' can comprise a matching threaded helical profile in order to engage the grooves in the grooved protruding structure. In such embodiments, thread pitch and thread start characteristics can be varied without requiring axial extension of the profile, as may be the case if, for example, the number of individual grooves was increased.

In some embodiments, the grooves on protuberance 611 are structured in such a manner that collet 330 is not able to migrate further downhole once the grooved structures are fully engaged by the outwardly biased grooved protuberance 460 of collet 330. In other embodiments, the grooves are structured so that upon the application of sufficient pressure, collet 330 can migrate further downhole, as further illustrated in FIGS. 10A-10D. Example groove geometries are shown in FIGS. 11A-11B. An example of a groove geometry permitting further downhole movement upon the application of pressure is shown in FIG. 11A. Shown in FIG. 11A is a groove geometry where outwardly biased protuberance 460 of collet 330 is engaged with inwardly biased protuberance 611 of shiftable element 610 of valve 220. However, the geometry of the protuberances 460 and 611 is such that some surfaces of the protuberance 460 are oriented at a given angle, such as 90 degrees in this example, while corresponding surfaces of the protuberances 611 are angled differently such that they are not exactly complimentary of one another. This leaves axial gaps between some of the angled surfaces of the protuberances 460 and 611, which allows for the collet 330 is to migrate further downhole upon exertion of sufficient pressure in the distal axial direction. For example, the shown angled surface 611*a* of the groove geometry of inwardly biased protuberance 611 can permit downward movement of collet 330. By contrast, the 90 degree angled surface 611*b*, shown in FIG. 11B, is complimentary to the corresponding angled surface on protuberance 460 and does not permit further downward movement of collet 330 after the collet 330 engages the corresponding shiftable valve. Referring to FIGS. 10A-10D, the foregoing example groove geometries permit collet 330 to move through valve 220*a* having the groove geometry shown in FIG. 11A upon the application of sufficient pressure, but not through valve 220*b*, having the groove geometry shown in FIG. 11B.

Referring back to FIGS. 6A-10D, shiftable element 610 can be releasably coupled and secured to housing 615 of shiftable valve 220. Shiftable valve 220 further comprises a plurality of side ports (two of which are labelled as 230 and 230' for ease of illustration). Initially, fluid can axially flow from the proximal end to the distal end of shiftable valve 220 through channel 605, and in a port closed position, there is no fluid communication between channel 605 and the space exterior of shiftable valve 220 via side ports (230, 230'). Upon engagement of protuberance 611 with a matching (i.e. complimentary angled) protuberance on a collet, shiftable element 610 can be shifted in the downhole direction. Movement in the downhole direction of shiftable element 610 causes shiftable valve 220 to shift from a port closed position to a port open position. In a port open position there exists fluid communication between channel 605 and the space exterior of the valve 220 via side ports (230, 230'). Details of the engagement between a collet and a shiftable valve in use are further shown in FIGS. 8A-8C.

Figure 9A:
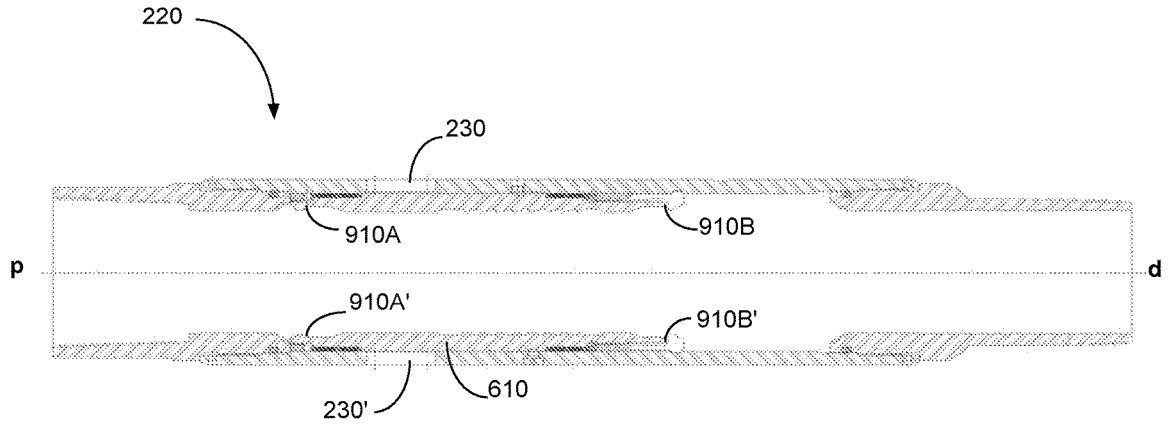
FIGS. 9A and 9B are cross-sectional views of a valve, and a valve and a collet with a ball, respectively.
Figure 9B:
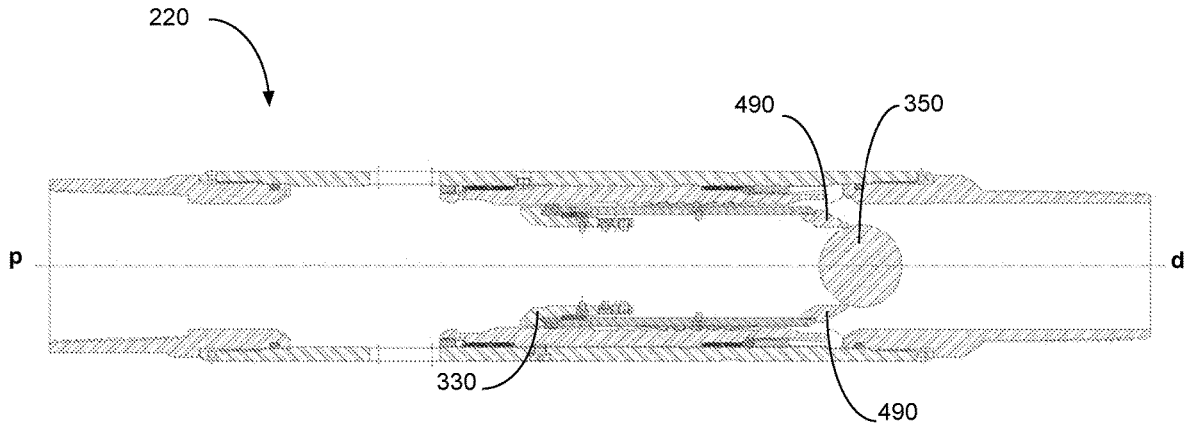

Shiftable element 610 can, in some embodiments, also comprise one or more tool engagement elements (910A, 910'A; 910B, 910'B) as shown in FIG. 9A. Tool engagement elements (910A, 910'A; 910B, 910'B) are capable of receiving a shifting tool such as, for example, a mechanical shifting tool to shift shiftable valve 220 from a port open position to a port closed position. The shifting tool can be operable, for example, by a control line, a wireline, a slickline, a coiled tubing or a rig.

As previously noted, initially collet 330 is secured to receptacle 340 by shearable members. Thus, as illustrated in FIG. 5A, initially collet 330 is secured to receptacle 340 by several groups of shear pins (415, 415'), (416, 416'), (417, 417'), and (418, 418'). Shear pins for a given collet and receptacle can be selected to shear at the same or, more preferably, different shear forces, ranging, for example, from 700 lbs-2,000 lbs per shear pin, and the number of circumferentially positioned shear pins can be varied, and can, for example vary from 2 to 10 pins. In one embodiment, the following shear pin configuration can be used: 4 shear pins 415 having a shear strength of about 700 lbs/pin; 10 shear pins 416 having a shear strength of about 700 lbs/pin; 8 shear pins 417 having a shear strength of about 2,000 lbs/pin; and 2 pins 418 having a shear strength of about 700 lbs/pin. When a force is applied to separate the collet 330 from the receptacle 340, for example, such as an electrical or a pressure-actuated force, initially shear pins (415, 415'), shearing at the lowest shear force load, shear resulting in a partial separation of receptacle 340 and collet 330 as depicted FIG. 7A. Shearing of shear pins (415, 415') is more clearly shown in FIGS. 7E and 7F. It is noted that shearing of shear pins (415, 415'), results in compression and outward expansion of sealing element 475, which can be, for example, an elastomeric ring. Ratchet 485 can then lock sealing element 475 in its outwardly expanded position. Outwardly expanded sealing element 475 can provide a seal upon movement of collet 330 within shiftable valve 220 (see: FIG. 8E).

Figure 7A:
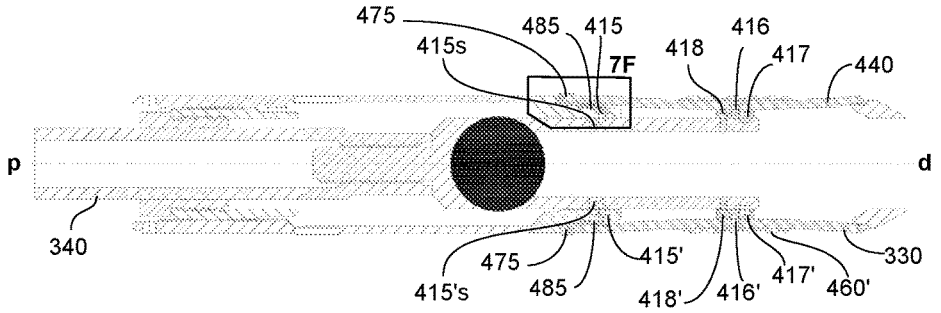
FIGS. 7A, 7B, and 7C are cross-sectional views of a receptacle and a collet with a ball in different states.
Figure 7B:
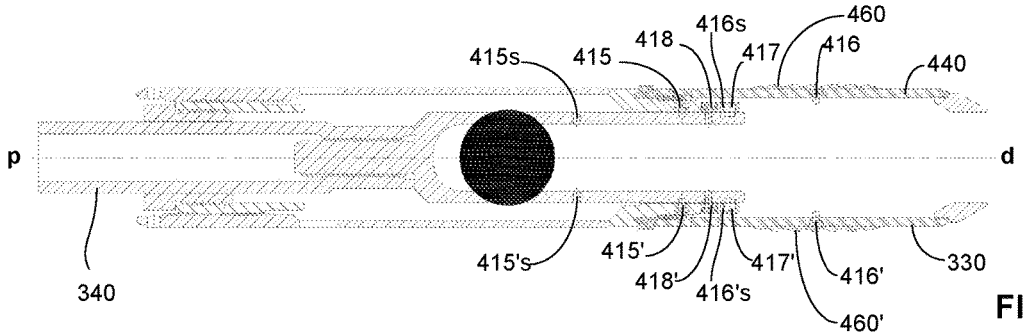

As shown in FIG. 7B, at a next stage, as further force is applied, shear pins (416, 416') shear, resulting in further partial separation between collet 330 and receptacle 340. It is noted that shearing of shear pins (416, 416') results in release of the inward compression of collet fingers 440, 440'. This effects further outer exposure of protuberances (460, 460'). When initially held in an inwardly compressed position, protuberances (460, 460') are protected from potential damaging contact with the walls of the tubular string or debris as the tethered collet migrates downhole.

Figure 7C:
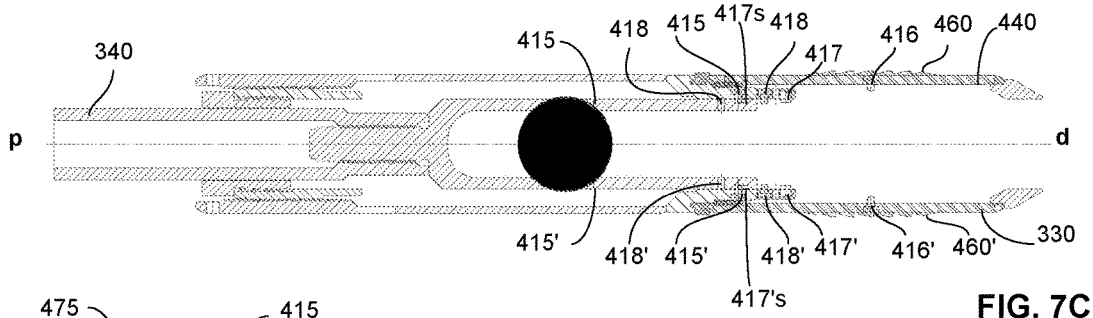
Figure 7E:
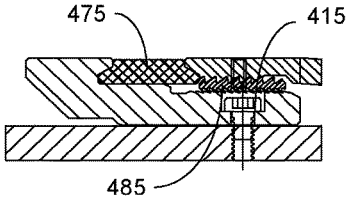
FIGS. 7E and 7F are enlarged cross-sectional views of the areas marked 7E and 7F in FIG. 5A and FIG. 7A, respectively.

As shown in FIG. 7C, at a next stage, as further force is applied, shear pin groups (417, 417') and (418, 418') shear more or less simultaneously, resulting in final separation between collet 330 and receptacle 340. Collet 330 is now no longer secured to receptacle 340.

Figure 7D:
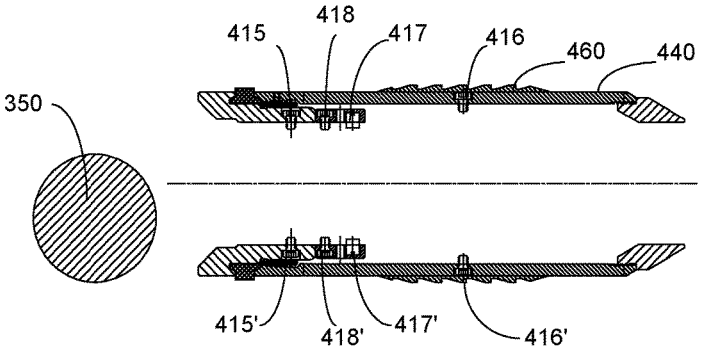
FIG. 7D is a cross sectional view of a collet with a ball.
Figure 7F:
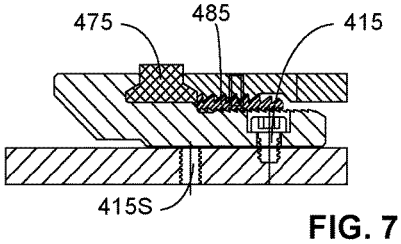

As shown in FIG. 7D, upon successive shearing of all shear pins (415, 415'), (416, 416'), (417, 417') and (418, 418'), full separation of receptacle 340 and collet 330, as well as ball 350 is achieved. Generally, upon removal of line 310, and receptacle 340 tethered thereto, from the wellbore, the application of induced flow rate in wellbore liner 215 creates a hydraulic force that can result in downhole movement of collet 330 and ball 350, until collet 330 can engage with a downhole shiftable valve as further shown in FIGS. 8A to 8E.

Figure 8A:
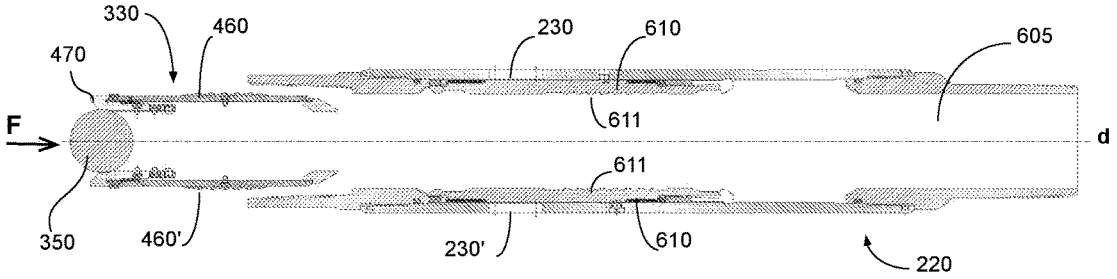
FIGS. 8A, 8B, 8C and 8D are cross-sectional views of a collet with a ball and a shiftable valve in different states.
Figure 8B:
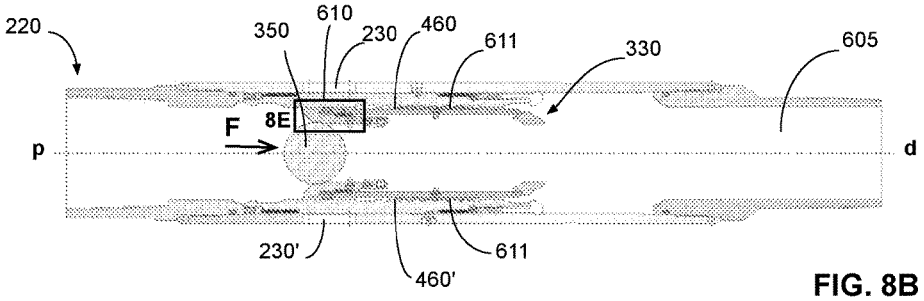
Figure 8C:
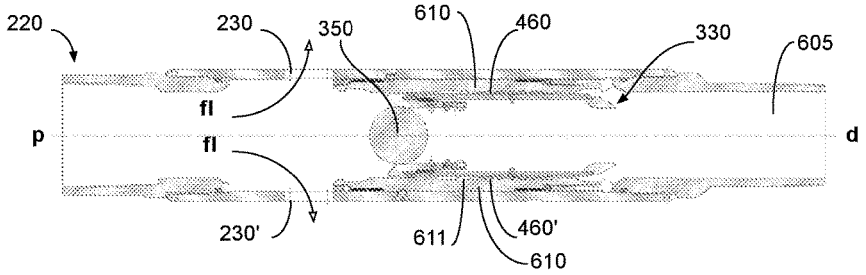
Figure 8E:
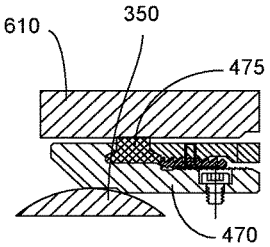
FIG. 8E is an enlarged cross-sectional view of the area marked 8E in FIG. 8B.

The engagement of collet 330 with shiftable valve 220 is further illustrated in FIGS. 8A to 8E. As shown in FIG. 8A, collet 330 can engage with shiftable valve 220. Shiftable element 610 is positioned in such a manner that initially there is no fluid communication between channel 605 and the space exterior of shiftable valve 220 via side ports (230, 230').

As shown in FIG. 8B, it can be appreciated that application of hydraulic force due to fluid flow F results in downhole movement of collet 330 within the channel 605 of shiftable valve 220 until the outwardly biased protuberances (460, 460') on collet 330 engage with inwardly biased protuberances 611 on shiftable element 610. At this state, ball 350 moves downhole in order to block the downhole axial fluid path through channel 605. Side ports (230, 230')

remain closed. Furthermore sealable element 475 presses against shiftable element 610 and forms a seal between ball seat 470 of collet 330 and shiftable valve 220, as depicted in FIG. 8E.

As shown in FIG. 8C, application of further hydraulic force from the fluid flow F moves shiftable element 610 downwards and results in opening of side ports (230, 230'). It can be appreciated that a pressure differential is created which will cause fluid to flow (as indicated by arrows fl) through side ports (230, 230') thereby establishing fluid communication between channel 605 and the exterior of shiftable valve 220. At this state, ball 350 fully engages with ball seat 470 of the collet 330 and blocks downhole fluid flow through channel 605.

Figure 8D:
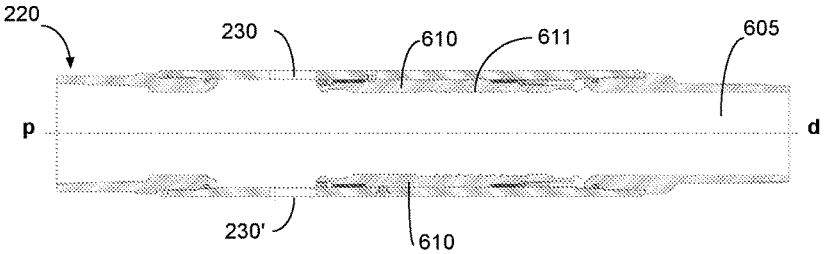

As noted above, in some embodiments, collet 330, or portions thereof, such as ball seat 470, protuberances 460, guiding element 490 and/or ball 350 can be manufactured using degradable materials. Upon degradation of collet 330 and ball 350, shiftable valve 220 remains in an open position as shown in FIG. 8D.

As hereinbefore noted, further operational embodiments are conceived. In one embodiment, a wellbore string 215 can comprise a plurality of side-ported shiftable valves, and a process for controlling fluid flow in a wellbore string 215 can be performed, where the process comprises:

deploying an actuation member 320 directly uphole from final shiftable valve 220*c*, situated furthest downhole on wellbore string 215, so that the actuation member 320 engages the shiftable valve 220*c* which then moves from a port closed position to a port open position to thereby direct fluid radially through valve 220*c* into a portion of the reservoir formation that surrounds final valve 220*c*.

In one embodiment, a wellbore string 215 comprises a central bore and a plurality of side-ported shiftable valves and a process for controlling fluid flow in wellbore string 215 can be performed where the process comprises:

deploying first actuation member 320 through the central bore directly uphole from valve 220*c* so that the first actuation member 320 operationally engages the valve 220*c* which then moves from a port closed position to a port open position and thereby directs fluid radially through the valve 220*c* into a first portion of the reservoir formation that surrounds the valve 220*c*, the valve 220*c* being situated furthest downhole on wellbore string 215; and thereafter deploying second actuation member 320 through the central bore directly uphole from valve 220*b* situated uphole from the valve 220*c* so that the second actuation member 320 operationally engages the valve 220*b* which then moves from a port closed position to a port open position and thereby directs fluid radially through the valve 220*b* into a second portion of the reservoir formation that surrounds the valve 220*b*.

It is noted that this embodiment can permit the performance of a single entry fracturing operation, as well as a limited entry fracturing operation. In a single entry operation, shiftable valve 220*c* can be opened to treat a first zone of a reservoir, and then the valve 220*b* can be opened to treat a second zone of the reservoir. In a limited entry operation, shiftable valve 220*c* and shiftable valve 220*b* can be opened to treat a first zone of a reservoir.

In one embodiment, wellbore string 215 comprises a central bore and a plurality of side-ported shiftable valves and a process for controlling fluid flow in wellbore string 215 can be performed where the process comprises:

deploying actuation member 320 in the central bore directly uphole from valve 220*b* so that the actuation member 320 operationally engages the valve 220*b* which then moves form a port closed position to a port open position so that fluid can be radially directed through the valve 220*b* into a portion of the reservoir formation that surrounds the valve 220*b*, and the valve 220*b* is not the furthest situated downhole valve on wellbore string 215.

In one embodiment, the tubular string comprises a central bore and a plurality of side-ported shiftable valves and a process for controlling fluid flow in wellbore string 215 can be performed where the process comprises:

deploying actuation member 320 directly uphole from tubular valve 220*a* so that the actuation member 320 engages and shifts the tubular valve 220*a* to a port open position so that fluid can be radially directed through the tubular valve 220*a* to a first portion of a reservoir formation that surrounds the tubular valve 220*a*, the tubular valve 220*a* being located uphole from at least one of the other tubular valves; and thereafter applying additional fluid flow to the central bore to engage a collet from the actuation member 320 with valve 220*b* that is downhole from the valve 220*a*, the engaging occurring through the corresponding protuberances and causing the valve 220*b* to shift from the port closed position to the port open position, and then plugging the central bore with a plug member from the actuation member 320, thereby directing fluid flow simultaneously through opened side ports in the tubular valves 220*a* and 220*b*.

Figure 10A:
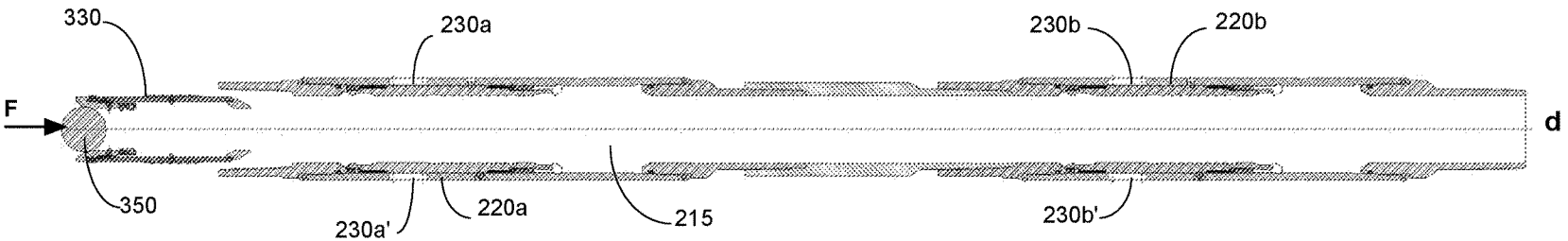
FIGS. 10A, 10B, 10C and 10D are cross sectional views of an assembly comprising two shiftable valves and a collet with a ball in different states.
Figure 10B:
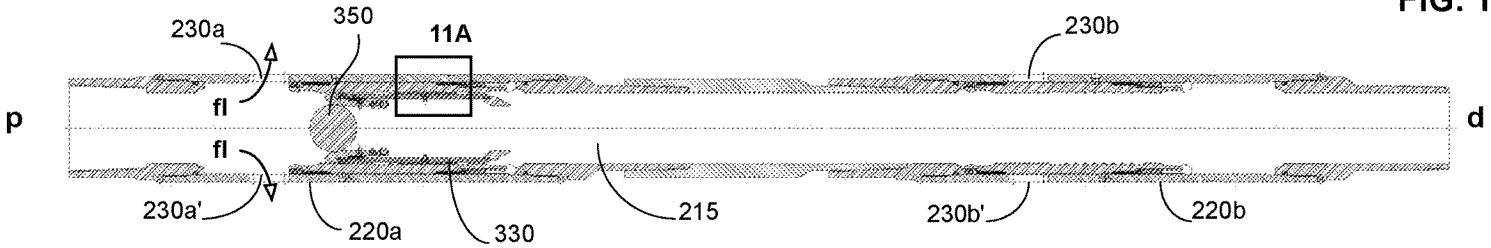
Figure 10C:
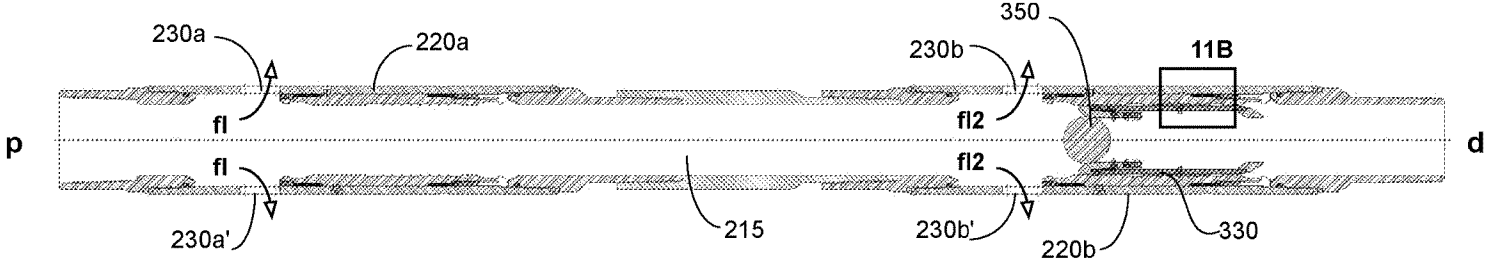

The foregoing embodiment is further illustrated in FIGS. 10A-10D. Initially, shiftable valves 220*a* and 220*b* are in a port closed position (FIG. 10A). Upon application of fluid flow F, collet 330 can engage with shiftable valve 220*a* and can shift valve 220*a* from a port closed position to a port open position so that fluid fl can exit radially from wellbore string 215 through ports (230*a*, 230*a'*), as shown in FIG. 10B. By applying further fluid flow, collet 330 can migrate further downhole and engage with shiftable valve 220*b* to move it from a port closed position to a port open position so that fluid fl2 can exit radially from wellbore string 215 through ports (230*b*, 230*b'*) as shown in FIG. 10C.

Figure 10D:
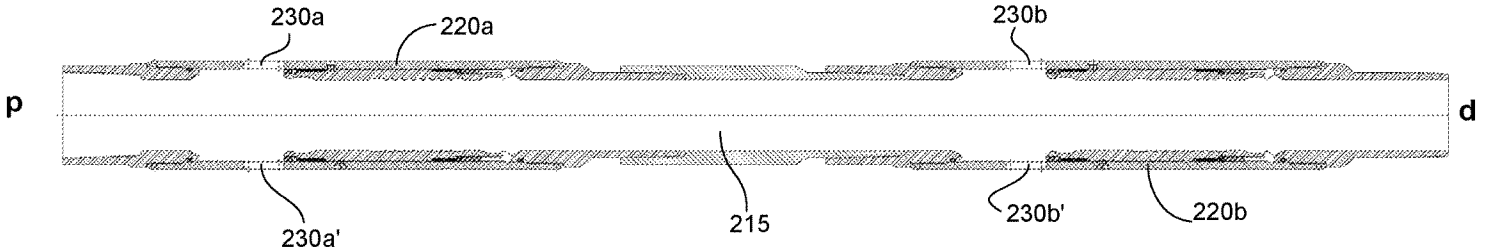
Figure 11A:
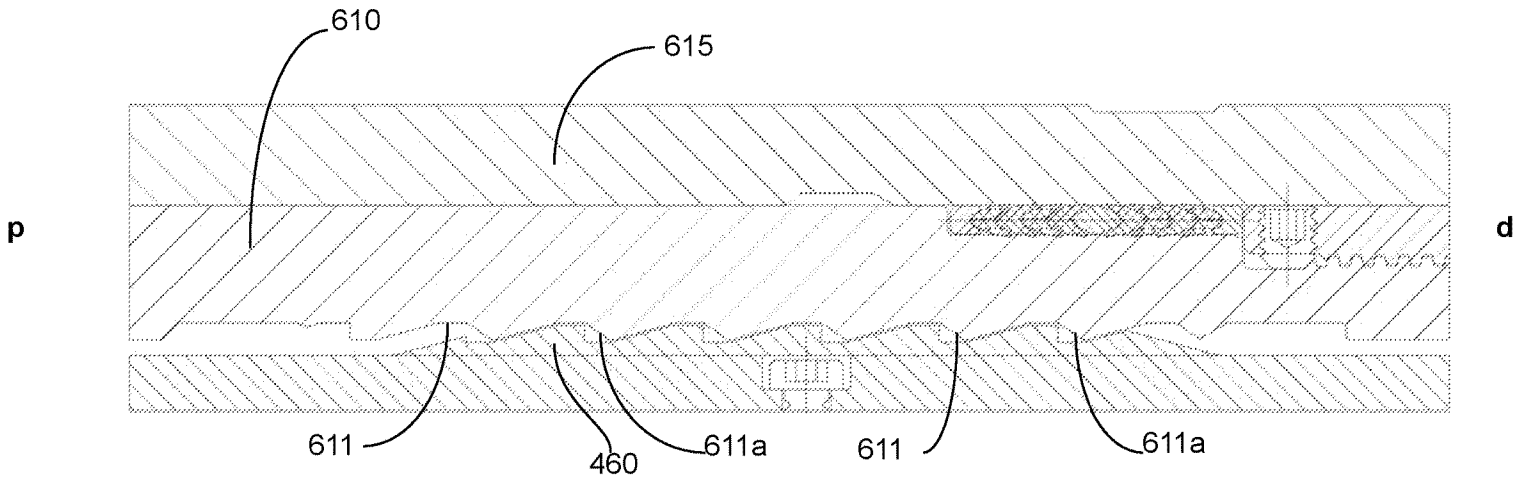
FIGS. 11A-B are enlarged cross-sectional views of the areas marked 11A and 11B, in FIG. 10B and FIG. 10C, respectively.
Figure 11B:
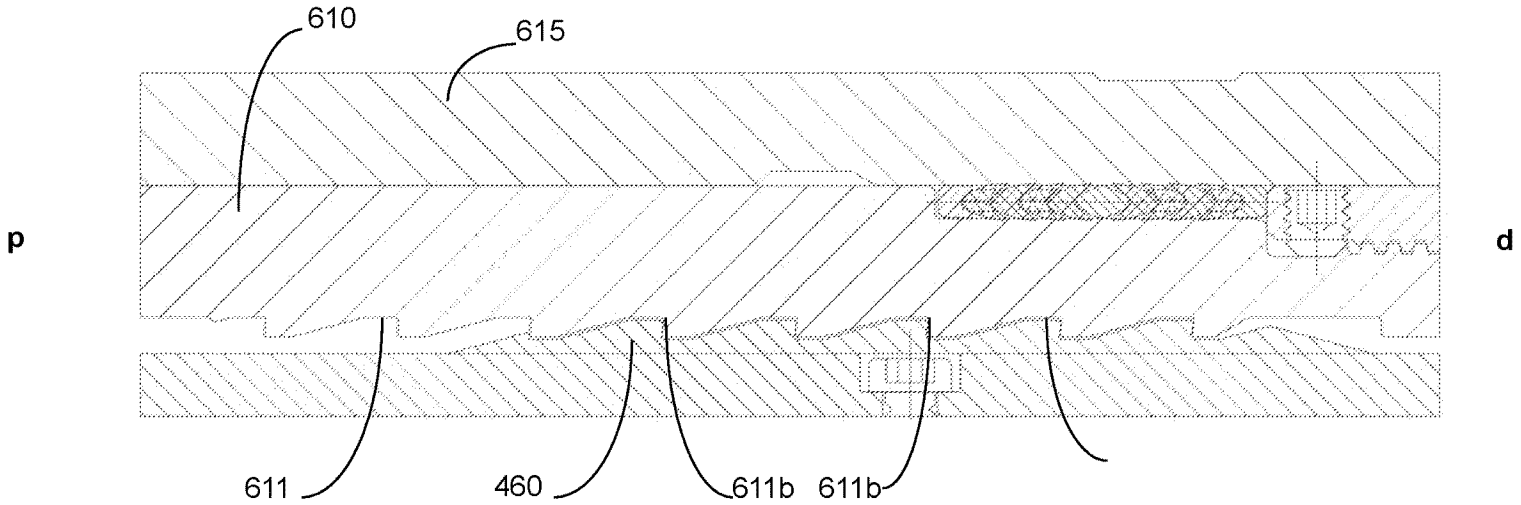

As hereinbefore noted, in some embodiments collet 330 and ball 350 can be manufactured from degradable materials. Degradation of collet 330 and ball 350 leaves the shown section of the wellbore string 215 unobstructed by collet 330 and in a port open position with respect to shiftable valves 220*a* and 220*b*, as shown in FIG. 10D. It is noted that this embodiment can permit a limited entry fracturing operation, i.e. the shiftable valve 220*a* and the shiftable valve 220*b* can be opened to treat a first zone of a reservoir.

As now can now be appreciated, the downhole assembly described herein can be conveniently used to control fluid flow in wells by deploying at least one valve actuation member to an accurately known location within the well, and exert tight control over engagement with a shiftable valve at that location. It can be applied in various oil or gas extraction processes.

The above disclosure generally describes various aspects of various example embodiments of apparatuses and processes of the present disclosure. It will be appreciated by a person skilled in the art having carefully considered the above description of representative example embodiments of the present disclosure that a wide variety of modifications, amendments, adjustments, substitution, deletions, and other changes may be made to these specific example embodiments, without departing from the scope of the present disclosure. Accordingly, the foregoing detailed description is to be understood as being given by way of example and illustration only, the spirit and scope of the present disclosure being limited solely by the appended claims.

The invention claimed is:

1. A downhole assembly for directing and controlling fluid flow in a wellbore string and a reservoir formation surrounding the wellbore string, the assembly comprising:

a tubular wellbore string having a central bore therethrough;

a shiftable side-ported tubular valve interconnecting first and second portions of the wellbore string, comprising at least one side port and being shiftable from a port closed position where fluid flow through the at least one side port is blocked to a port open position where fluid flow through the at least one side port is allowed, the side-ported tubular valve having at least one inwardly biased protuberance; and an actuation member disposed within the central bore, the actuation member comprising:

a receptacle tethered to a line deployment device;

a plug member disposed within the receptacle; and a collet releasably coupled to the receptacle by a releasable coupling, the collet having at least one outwardly biased protuberance for correspondingly engaging with the at least one inwardly biased protuberance of the tubular valve, the plug member being engageable with the collet, wherein, upon release of the collet from the receptacle, the collet and the plug member while engaging one another are moveable downhole by application of a downhole directed fluid flow in the central bore, the collet being moved downhole to engage with the tubular valve through the corresponding protuberances and to cause the tubular valve to shift from the port closed position to the port open position, and the plug member being moved downhole to plug the central bore downstream of the at least one side port, and to thereby direct fluid flow through the at least one side port to a portion of the reservoir formation surrounding the wellbore string.

2. The assembly according to claim 1, wherein the wellbore string comprises a plurality of spaced apart side-ported tubular valves each interconnecting successive portions of the wellbore string.

3. The assembly according to claim 2, wherein each of the tubular valves comprises an inwardly biased protuberance for preventing further downhole movement of the collet upon the application of fluid flow to the collet and plug member while being engaged with each other.

4. The assembly according to claim 2, wherein the tubular valve situated furthest downhole has an inwardly biased protuberance preventing further downhole movement of the collet upon the application of fluid flow to the collet, and all other tubular valves have an inwardly biased protuberance that is structured to permit further downhole movement of the collet upon the application of sufficient fluid flow to the collet and plug member while being engaged with each other.

5. The assembly according to claim 1, wherein releasable coupling comprises two or more shearable members, each shearable member being shearable at a different shear force.

6. The assembly according to claim 1, wherein the collet comprises a shearable member, the collet being inwardly compressed when the shearable member is intact and the collet experiencing an outward expansion upon shearing of the shearable member.

7. The assembly according to claim 1, wherein the collet comprises an inwardly narrowing element sized to receive the plug member and restrict fluid flow downhole of the received plug member.

8. The assembly according to claim 1, wherein the at least one inwardly and outwardly biased protuberances each comprise a plurality of matching grooves with angled surfaces.

9. The assembly according to claim 1, wherein the collet is manufactured using a degradable material.

10. The assembly according to claim 1, wherein the plug member is manufactured using a degradable material.

11. A process for controlling fluid flow in a wellbore string, the process comprising:

installing a wellbore string having a central bore therethrough and comprising a side-ported tubular valve interconnecting two successive portions of the string, the tubular valve being shiftable from a port closed position to a port open position with at least one opened side port, and having at least one inwardly biased protuberance;

deploying an actuation member directly uphole from the tubular valve in the central bore, the actuation member comprising a tethered receptacle, a plug member disposed within the receptacle, and a collet that is coupled to the receptacle with a releasable coupling and has at least one outwardly biased protuberance for correspondingly engaging with the at least one inwardly biased protuberance of the tubular valve and the plug member being engageable with the collet;

releasing the collet from the receptacle; and applying a controlled fluid flow in the central bore to:

engage the plug member with the collet and move the collet and plug member downhole for engaging the tubular valve through the corresponding protuberances and causing the tubular valve to shift from the port closed position to the port open position, and to plug the central bore with the plug member downstream of the port open position thereby directing fluid flow radially through at least one opened side port to a portion of the reservoir formation surrounding the tubular valve.

12. The process according to claim 11, wherein the controlled fluid is at least one of water, a stimulation fluid, a proppant slurry, an acid, a base, a produced fluid or a reactive agent.

13. The process according to claim 11, wherein the wellbore string is installed in a cased hole wellbore.

14. The process according to claim 11, wherein the wellbore string is installed in an open hole wellbore.

15. The process according to claim 11, wherein the actuation member is deployed directly uphole from the tubular valve by the application of the fluid flow and the fluid flow is substantially reduced to engage the plug member with the collet and move the collet and plug member downhole.

16. The process according to claim 15, wherein the tethered receptacle is deployed using a line deployment device and wherein the receptacle is removed from the wellbore string following release of the collet from the receptacle using the line deployment device.

17. The process according to claim 11, wherein the wellbore string comprises a plurality of side-ported tubular valves interconnecting successive portions of the wellbore string and the process comprises deploying the actuation member directly uphole from a final tubular valve that is situated furthest downhole on the wellbore string to thereby direct fluid through at least one side port of the final tubular valve to a portion of the reservoir formation surrounding the final tubular valve.

18. The process according to claim 11, wherein the wellbore string comprises a plurality of side-ported tubular valves interconnecting successive portions of the wellbore string and the process comprises:

deploying a first actuation member directly uphole from a first tubular valve to engage the first tubular valve thereby directing fluid radially through at least one side port of the first tubular valve into a first portion of a reservoir formation surrounding the first tubular valve; and thereafter deploying a second actuation member directly uphole from a second tubular valve that is situated uphole from the first tubular valve, to engage the second tubular valve to thereby direct fluid radially through at least one side port of the second tubular valve into a second portion of a reservoir formation surrounding the second tubular valve.

19. The process according to claim 11, wherein the wellbore string comprises a plurality of side-ported tubular valves interconnecting successive portions of the wellbore string and the process comprises deploying a first actuation member directly uphole from a first tubular valve to shift the first tubular valve to the port open position to direct fluid radially through at least one side port of the first tubular valve to a first portion of a reservoir formation that surrounds the first tubular valve, the first tubular valve being situated uphole from a final tubular valve that is located furthest downhole on the wellbore string.

20. The process according to claim 11, wherein, the wellbore string comprises a plurality of side-ported tubular valves interconnecting successive portions of the wellbore string and the process comprises:

deploying a first actuation member directly uphole from a first tubular valve to shift the first tubular valve to the port open position and to direct fluid radially through at least one side port of the first tubular valve to a first portion of a reservoir formation that surrounds the first tubular valve, the first tubular valve being located uphole from at least one of the other tubular valves; and thereafter applying additional fluid flow to the central bore to engage a collet from the first actuation member with a second valve downhole from the first valve, the engaging occurring through the corresponding protuberances and causing the second valve to shift from the port closed position to the port open position, and to plug the central bore with a plug member from the first actuation member, and thereby directing fluid flow simultaneously through opened side ports in the first and second tubular valves.

* * * * *